US008439166B2

(12) United States Patent
Kreller

(10) Patent No.: US 8,439,166 B2
(45) Date of Patent: May 14, 2013

(54) VERTICAL FRAME INTENDED FOR THE CONSTRUCTION OF A FRAME SUPPORT, A SUPPORTING SCAFFOLD AND/OR A SUPPORTING SCAFFOLD TOWER

(75) Inventor: Helmut Kreller, Bad Rappenau (DE)

(73) Assignee: Wilhelm Layher Verwaltungs-GmbH, Gueglingen-Eibensbach (DE)

( * ) Notice: Subject to any disclaimer, the term of this patent is extended or adjusted under 35 U.S.C. 154(b) by 287 days.

(21) Appl. No.: 12/735,524

(22) PCT Filed: Nov. 8, 2008

(86) PCT No.: PCT/DE2008/001848

§ 371 (c)(1),
(2), (4) Date: Jul. 23, 2010

(87) PCT Pub. No.: WO2009/092340

PCT Pub. Date: Jul. 30, 2009

(65) Prior Publication Data

US 2010/0313516 A1 Dec. 16, 2010

(30) Foreign Application Priority Data

Jan. 24, 2008 (DE) ..... 10 2008 006 911

(51) Int. Cl.
*E04G 7/00* (2006.01)

(52) U.S. Cl.
USPC ..... 182/178.1

(58) Field of Classification Search ..... 182/178.1, 182/178.5, 228.1
See application file for complete search history.

(56) References Cited

U.S. PATENT DOCUMENTS

| | | | | |
|---|---|---|---|---|
| 4,044,523 | A | 8/1977 | Layher | |
| 4,493,578 | A * | 1/1985 | D'Alessio | 403/49 |
| 4,830,144 | A * | 5/1989 | Werner | 182/178.5 |
| 4,867,274 | A | 9/1989 | Langer | |
| 4,958,702 | A * | 9/1990 | Langer | 187/406 |
| 5,046,879 | A | 9/1991 | Langer nee Layher | |
| 5,127,757 | A | 7/1992 | Langer | |

(Continued)

FOREIGN PATENT DOCUMENTS

| | | |
|---|---|---|
| DE | 24 49 124 | 4/1976 |
| DE | 34 07 425 | 9/1985 |

(Continued)

OTHER PUBLICATIONS

Australian Examination Report dated May 3, 2011 in Australian Application No. 2008348861.

(Continued)

*Primary Examiner* — Katherine Mitchell
*Assistant Examiner* — Kristine Florio
(74) *Attorney, Agent, or Firm* — Collard & Roe, P.C.

(57) ABSTRACT

A closed vertical frame for constructing a supporting frame, including at least two vertical supports disposed at a horizontal distance from each other, and at least two horizontal arms disposed at a vertical distance from each other. Each extends between the at least two vertical supports transversely to the vertical supports. A first horizontal arm is welded on both ends to a respective vertical support near the upper end thereof, and a second horizontal arm is welded on both ends likewise to these vertical supports near the lower end thereof. The vertical frame is reinforced with at least one diagonal rod extending between two vertical supports and two horizontal arms and is welded onto two vertical supports. Near the respective upper and/or lower end, a perforated disk having openings is welded to connect holding devices.

12 Claims, 11 Drawing Sheets

U.S. PATENT DOCUMENTS

Figure 1:
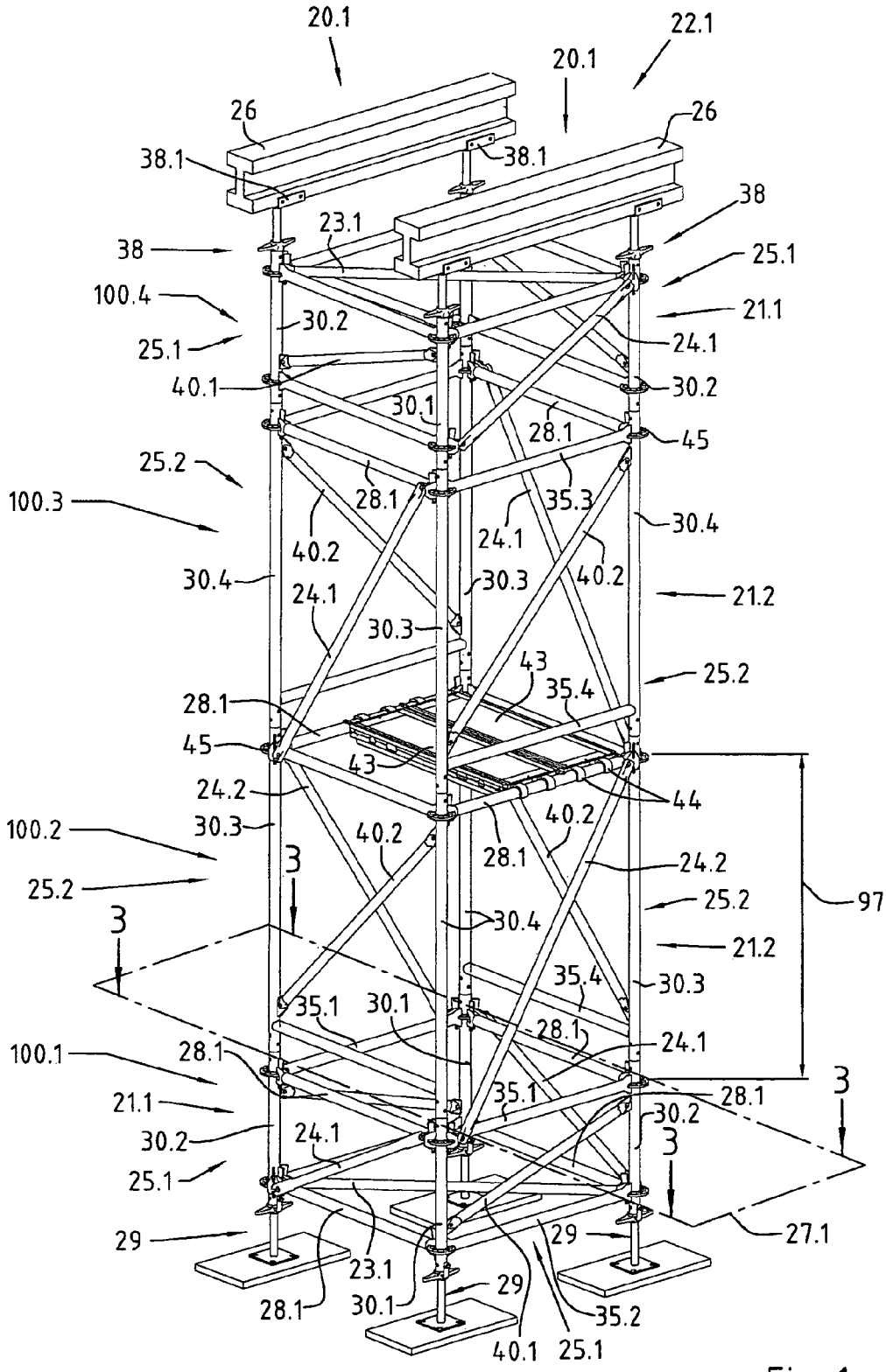

| | | | | |
|---|---|---|---|---|
| 5,411,113 | A * | 5/1995 | Lubinski | 182/186.7 |
| 6,302,422 | B1 | 10/2001 | Liu | |
| 7,017,710 | B2 * | 3/2006 | Booysen et al. | 182/178.1 |
| 2002/0036118 | A1 | 3/2002 | Ono | |
| 2006/0039746 | A1 | 2/2006 | Stringer | |

FOREIGN PATENT DOCUMENTS

| | | |
|---|---|---|
| DE | 37 02 057 | 8/1988 |
| DE | 39 09 809 | 9/1990 |
| DE | 39 34 857 | 4/1991 |
| DE | 198 06 094 | 8/1999 |
| DE | 299 06 742 | 12/1999 |
| DE | 200 12 589 | 11/2000 |
| DE | 199 48 081 | 5/2001 |
| EP | 0 276 487 | 8/1988 |
| EP | 0 389 933 | 10/1990 |
| EP | 0 423 516 | 4/1991 |
| EP | 0 936 327 | 8/1999 |
| EP | 1 045 088 | 10/2000 |
| EP | 1 301 673 | 4/2004 |
| EP | 1 452 667 | 9/2004 |
| GB | 1 213 487 | 11/1970 |
| GB | 2 155 140 | 9/1985 |
| WO | WO 02/06610 | 1/2002 |

OTHER PUBLICATIONS

International Search Report, Apr. 14, 2009.
German Search Report dated Nov. 28, 2008 with English translation of relevant parts.
European Office Action dated Jul. 6, 2010 with English translation of relevant parts.

* cited by examiner

VERTICAL FRAME INTENDED FOR THE CONSTRUCTION OF A FRAME SUPPORT, A SUPPORTING SCAFFOLD AND/OR A SUPPORTING SCAFFOLD TOWER

CROSS REFERENCE TO RELATED APPLICATIONS

This application is the National Stage of PCT/DE2008/001848 filed on Nov. 8, 2008, which claims priority under 35 U.S.C. §119 of German Application No. 10 2008 006 911.6 filed on Jan. 24, 2008. The international application under PCT article 21(2) was not published in English.

The invention relates to a closed vertical frame intended for the construction of a frame support, particularly of a stacking tower support, preferably of a supporting scaffold, particularly of a falsework, preferably of a supporting scaffold tower, falsework tower or stacking tower, which comprises at least two, preferably precisely two, particularly parallel vertical supports disposed at a horizontal distance relative to one another, and which comprises at least two, preferably precisely two, particularly parallel horizontal arms disposed at a vertical distance relative to one another, which arms extend, preferably between the at least two vertical supports, transverse, particularly perpendicular, to these vertical supports, whereby a first horizontal arm of these horizontal arms is welded on, at both ends, to one of the vertical supports, in each instance, in the region of their upper ends, and whereby a second horizontal arm of these horizontal arms is also welded on, at both ends, at these two vertical supports, in the region of their lower ends, and whereby the vertical frame is reinforced with at least one, preferably with a single or only with a first and with a second diagonal rod, which rod extends between two of the vertical supports and two of the horizontal arms, preferably between two of the vertical supports as well as the first horizontal arm and the second horizontal arm, and which rod is welded onto two of the vertical supports or onto two of the horizontal arms, preferably the first horizontal arm and the second horizontal arm, or both onto a vertical support of the vertical supports and onto a horizontal arm of the horizontal arms.

Such vertical frames have been known for decades, in general, as design components of frame supports, particularly stacking tower supports, or of supporting scaffolds, particularly falseworks, or of towers built up from them, in other words supporting scaffold towers, particularly falsework towers or stacking towers. Such frame supports are also called frame scaffolding, in which disk-shaped standard parts, particularly the vertical frames, are assembled to form towers. The advantage of the frame supports lies in the pre-manufactured modular system, which allows assembly by untrained persons. The height can be precisely adjusted by means of foot and head spindles. Using the foot spindles, it is also possible to bridge uneven ground areas in simple manner. Using the head spindles, it is possible to adjust the linings, for example head forks for yoke carriers, particularly scantlings and the like, to different heights. Such frame supports have also become known under the designation stacking tower supports.

The vertical frames mentioned initially can also form essential components of supporting scaffolds or so-called falseworks. Supporting scaffolds are understood to mean, in particular, non-permanent, in other words only temporary constructions of steel or wood, having a comparatively short useful lifetime and great frequency of use. They are assembled from multiple individual parts for the purpose of use, in each instance, and after they have fulfilled their purpose, they are disassembled again.

Supporting scaffolds serve to carry away high vertical loads. In this connection, these are generally supporting loads and/or concrete-pouring loads during the construction phase. Supporting scaffolds therefore serve, for example, to support makeshift steel constructions, securing systems, remodeling systems or concrete-pouring loads during concrete-pouring, while the concrete is not yet capable of carrying a load. In this case, the supporting scaffold must carry not only the weight of the concrete but also the inherent weight of the form boards and the traffic loads during concrete-pouring. Supporting scaffolds therefore serve for temporary support or bracing of form boards for fresh concrete as well as of components made of steel, wood, or finished parts.

The net loads to be absorbed by supporting scaffolds are high in comparison with the inherent weight of the supporting scaffolds. Supporting scaffolds are also referred to, in part, as falseworks, and vice versa, whereby the term falsework is a very old designation. Falseworks or supporting scaffolds can be structured in the form of one or more towers coupled with one another by means of connecting elements, in other words as supporting scaffold towers or falsework towers. In this connection, in general multiple modular construction units having the same or a similar structure, are disposed one on top of the other, in story blocks or in height blocks, or so-called shots, and fixed in place relative to one another when this is done. Nowadays, steel-pipe/rod support systems are predominantly used for this purpose. In this connection, the vertical supports of the vertical frames, in each instance, also referred to as posts, which generally consist of steel pipes, are inserted onto or into one another using pipe connectors and the like, whereby in general, two similar vertical frames, spaced apart horizontally, are used, which are particularly connected with one another by way of diagonal braces spaced apart horizontally, and reinforced with regard to one another. In this connection, so-called cross-diagonals or diagonal crosses, consisting of two diagonals that intersect one another and span a common vertical plane, can be used.

The supporting scaffolds generally have a square or rectangular outline, i.e. the two vertical frames that are horizontally spaced apart and span a vertical frame plane, in each instance, are connected with one another by way of releasable diagonals that extend perpendicular to the vertical frame planes, if necessary also by way of additional releasable horizontal braces, forming such outlines.

In this manner, a support system of rods is obtained per height block or per shot, which system is delimited laterally by rods that span four vertical planes, whereby adjacent vertical planes stand perpendicular to one another.

When constructing supporting scaffolds having a square outline, the two vertical frames per height block or shot are generally disposed offset by 90 degrees relative to one another, in order to increase the stability of the supporting scaffold.

Such supporting scaffolds, composed of pre-finished, closed vertical frames, can be built up and disassembled again in manageable, simple, and rapid manner. Because of the comparatively low number of basic components required per height block, handling and transport of such supporting scaffolds can also be implemented in simple and cost-advantageous manner.

The diagonals that connect the vertical frames are predominantly connected with the posts or vertical frames either by way of horizontal cross-bolts provided with tilt pins and welded onto the posts of the vertical frames, onto which bolts their perforated ends are set, or by way of snap-in claws attached at their ends, which are engaged into one of the horizontal braces of the vertical frames, in each instance.

Other supporting scaffolds or falseworks have become known, which are based on scaffold components of so-called modular scaffolds. These are built up from separate, individual scaffold elements, for example from posts as well as horizontal and/or diagonal connecting elements. The connecting elements have connecting heads at their ends, which serve as holding devices, by means of which they can be suspended into accommodation elements, so-called connection nodes, and fixed in place on them. These connection nodes are affixed at regular length intervals, i.e. in a specific grid dimension, along the posts, on the latter. In particular, longitudinal cross-bars, transverse cross-bars and/or diagonal rods can be used as horizontal and/or diagonal connecting elements. From these individual components, it is possible to construct very stable scaffolds, which are also resistant to bending and twisting. Such a modular scaffolding system of the applicant has established itself on the market as a synonym for modular scaffolding, as the Layher Allround scaffolding.

With its unique connection technology, the so-called Allround node of the applicant has replaced traditional scaffold construction technology. With the individual Allround scaffold elements, it is possible to implement applications in a unique variety of uses. The Allround scaffolding system of the applicant meets the tasks and requirements on every construction site, in industry, chemistry, in power plants and shipyards, in the events sector, for example for podia and stairways, as scaffolding for work protection, facades, or support scaffolds, as interior scaffolding, mobile scaffolding, or ceiling scaffolding and/or with the most difficult outlines and architectures and under stringent safety requirements, in outstanding manner.

The vertical scaffold posts of this modular scaffolding, configured with round pipes, are provided, at regular length intervals, with so-called perforated disks that are attached to the posts by means of welding. These perforated disks are disposed concentric to the posts and surround the post, in each instance, in the manner of a flange, over its full circumference. The perforated disks have multiple small and large perforations, which are alternately disposed at the same circumference angles relative to one another. In this way, the connecting heads of horizontal and/or diagonal connecting or scaffold elements, particularly of longitudinal and/or horizontal cross-bars as well as diagonal rods, can be suspended at these perforations, specifically, in total, preferably up to eight such holding devices or connecting elements.

The connecting heads, in each instance, have an upper and a lower head part, having a wedge opening, in each instance, for a wedge that can be inserted through these wedge openings and through one of the perforations of the related perforated disk, by means of which wedge the connecting head provided with a slit disposed between the upper head part and the lower head part and set onto the perforated disk can be wedged in place on the post.

The connecting heads of such a modular scaffold are usually connected as separate components, i.e. in multiple pieces, with the rod-shaped connecting element, in each instance, by means of welding. Such connecting heads, along with perforated disks and connecting elements, have become known, for example, from DE patent 24 49 124, DE 37 02 057 A or the parallel EP 0 276 487 B1, DE 39 34 857 A1 or the parallel EP 0 423 516 B2, DE 198 06 094 A1 or the parallel EP 0 936 327 B1 and the parallel EP 1 452 667 B1 of the applicant. Alternative perforated disk embodiments are evident, for example, from DE 39 09 809 A1 or the parallel EP 0 389 933 B1 and DE 200 12 598 U1 as well as the parallel WO 02/06610 A1 and the parallel EP 1 301 673 A1 of the applicant. A scaffold pipe of a metal pipe scaffold, in which the scaffold pipe is in one piece and provided with a formed-on connecting head, made of the same material, is evident, for example, from DE 34 07 425 A1 of the applicant.

It is possible to construct vertical frame elements or vertical frames that have the configurations mentioned initially, among other things, from the scaffold elements indicated above, i.e. the posts provided with multiple perforated disks and the rod elements provided with slit connecting heads, for example the diagonals and the transverse cross-bars.

It is a task of the invention to make available a vertical frame of the type mentioned initially and/or a frame support formed from it, particularly a stacking tower support and/or supporting scaffold formed from it, particularly falsework, and/or a supporting scaffold tower formed from it, particularly a falsework tower or stacking tower, which is easy and simple to handle and can be used in varied ways, demonstrates great stability, can be produced in relatively cost-advantageous manner, and can be combined with a modular scaffold designed according to a grid dimension, with the possibility of utilizing the many varied connection possibilities that exist in such a scaffold, for horizontal and/or diagonal rod-shaped connecting elements and/or holding elements.

In particular, the invention is concerned with combining the advantages of frame supports, particularly falsework tower supports and/or supporting scaffolds, particularly falseworks and/or supporting scaffold towers, particularly falsework towers or stacking towers, which can be or are built up from pre-manufactured, closed vertical frames, with the advantages of modular scaffolding systems, so that expanded application and use possibilities and/or cost savings effects exist, particularly by means of an advantageous possibility for simple, flexible, and variable adaptation of the distances between the posts or vertical supports, particularly of horizontally adjacent vertical frames, or support constructions, adapted to the load conditions that prevail on site, or the bracing forces or support widths that prevail on site, for reliable bracing of support loads.

The task of the invention is preferably accomplished by means of the characteristics of claim 1, particularly in that a perforated disk provided with multiple perforations, for connecting holding devices, particularly for suspending supporting and/or connecting elements, preferably scaffold elements that run horizontally and/or diagonally, for example scaffold cross-bars and/or scaffold diagonals, particularly of a modular scaffold, are permanently attached, preferably by means of welding, in the region of the upper end, in each instance, and/or in the region of the lower end, in each instance, of at least two of the vertical supports of the vertical frame, preferably on the two vertical supports disposed farthest on the outside, particularly on all the vertical supports, whereby the perforated disk or each perforated disk of these perforated disks is disposed concentric to the vertical support and surrounds the vertical support in flange-like manner, and whereby the first horizontal arm and/or the second horizontal arm comprise(s) a, preferably a single, particularly straight horizontal brace, which is configured or provided, in each instance, at its ends facing away from one another, with a connecting head formed in one piece or multiple pieces with the horizontal brace. Preferably, the connecting head is delimited with side wall parts that have vertical outer surfaces that run, in the manner of a wedge, toward a center, particularly toward a post and disk center of the related perforated disk, which surfaces enclose a wedge angle amounting particularly to 40 degrees to 50 degrees, preferably about 45 degrees, particularly 44 degrees. Preferably, the connecting head has an upper head part and a lower head part, which are connected with one another, particularly in one piece, preferably configured in one piece, and whereby a slit that is open toward the related vertical support and also toward the sides is provided between the upper head part and the lower head part, by means of which slit the connecting head is set onto the perforated disk, which projects at least partly into it. The connecting head is welded on, preferably in this position, to the vertical support, preferably also to the perforated disk.

Because a perforated disk provided with multiple perforations is attached, in each instance, at least in the region of the upper end, in each instance, and/or in the region of the lower end, in each instance, of at least two of the vertical supports of the vertical frame, for connecting holding devices, particularly for suspending supporting and/or connecting elements, preferably scaffold elements that run horizontally and/or diagonally, for example scaffold cross-bars and/or scaffold diagonals, particularly of a modular scaffold, permanently, preferably by means of welding, which disks are disposed concentric to the vertical support and surround the vertical support in flange-like manner, such vertical frames can be built up using horizontal and/or diagonal holding devices known from modular scaffolds and provided with perforated-disk connecting heads, particularly scaffold cross-bars and/or scaffold diagonals, to form a particularly rigid and stable supporting scaffold or height block of a supporting scaffold, making it possible to build up particularly rigid and stable supporting scaffold towers.

Furthermore, such vertical frames or the frame supports or supporting scaffolds or supporting scaffold towers built up from them can be connected in conventional manner, using such holding devices intended for connecting to the perforated disks such as scaffold elements that run horizontally and/or diagonally, particularly scaffold cross-bars and/or scaffold diagonals of a modular scaffold, so that a conventional modular scaffold can be built up directly subsequent to and firmly connected with the vertical frame or a frame support built up from it or a supporting scaffold or a supporting scaffold tower built up from it, thus connected in torsion-resistant manner. In this manner, combinations of frame supports or supporting scaffolds or supporting scaffold towers can be built up, serving particularly as facade and work scaffolds and the like, as modular scaffolds.

Furthermore, the vertical frames according to the invention can be built up with horizontally adjacent vertical frames according to the invention, particularly similar or identical vertical frames, now by means of diagonal and/or horizontal scaffold elements having different lengths, for a connection to holding devices intended for the perforated disks, particularly scaffold elements that run horizontally and/or diagonally, such as scaffold cross-bars and/or scaffold diagonals of a modular scaffold, to form supporting scaffolds or height blocks of supporting scaffolds or supporting scaffold towers that accordingly have different outlines, so that an adaptation of the carrying capacity of such a supporting scaffold or supporting scaffold tower can be achieved in simple manner, by means of compressing or stretching its outline in one direction. Accordingly, the distances between posts or the distances between the vertical supports of the horizontally adjacent vertical frames can be adapted to the load to be supported, in each instance. This means an advantageous possibility for cost optimization as compared with the constructions according to the state of the art.

Because the first horizontal arm and/or the second horizontal arm of the vertical frames has a connecting head configured for connecting to the perforated disks, on both ends, in each instance, which head has an upper head part and a lower head part, in each instance, and a slit configured between these, with which the connecting head, in each instance, is set onto the perforated disk, in each instance, which projects at least partly into the slit, and is welded to the vertical support, in each instance, in this set-on position, preferably also to the perforated disk, in each instance, it is possible to implement vertical frames having particularly great stability, particularly anti-twist rigidity. As a result, and by means of the connection possibility of other reinforcing holding devices, as described above, particularly of scaffold elements of a modular scaffold that run horizontally and/or diagonally, it is possible to build up particularly stable supporting scaffolds or supporting scaffold towers.

Because the connecting heads are delimited with side wall parts that have vertical surfaces that run, in wedge-like manner, toward a center, particularly toward a post and disk center of the related perforated disk, which surfaces enclose a wedge angle that amounts to particularly 40 degrees to 50 degrees, preferably about 45 degrees, particularly about 44 degrees, it is possible to connect a plurality of at least up to seven connecting heads of holding devices or supporting and/or connecting elements, in known manner, particularly scaffold elements that run horizontally and/or diagonally, particularly of a modular scaffold, there, if necessary with reciprocal bracing.

Using such vertical frames according to the invention, provided with perforated disks, it is possible to build up not only supporting scaffolds or supporting scaffold towers, if necessary, which have the quadragonal, particularly rectangular or square outlines that have been usual until now, but rather it is also possible to also implement polygonal outlines, for example triangular, pentagonal, hexagonal, or octagonal closed outlines. In this manner, even greater flexibility or variability in the construction of supporting scaffolds or supporting scaffold towers using such vertical frames can be achieved.

A particularly good permanent connection to the vertical support of the vertical frames can be achieved, in each instance, in that the upper head part and the lower head part of the connecting heads of the horizontal arm, in regions of their vertical outer surfaces, if necessary also in regions of their horizontal outer surfaces that follow, toward the outside, the vertical wall parts that lie against the related vertical support and/or lie opposite to it at a slight distance, are welded to the related vertical support, by way of a continuous weld seam, in each instance, if necessary with the exception of at least one liquid run-off opening that is provided, if necessary.

Furthermore or in addition, it can be provided that the upper head part and the lower head part of the connecting heads, in regions of their vertical outer surfaces that follow, toward the outside, the horizontal slit surfaces of the slit of the connecting head, in each instance, are welded, over the entire width of the part of the related perforated disk that projects into the slit of the connecting head, in each instance, by way of a continuous weld seam, in each instance, to the related perforated disk. In this way, an even better connection and an even more stable, particularly more twist-resistant vertical frame can be achieved.

A further improved permanent connection and further improved vertical frame, with regard to its stability, particularly its anti-twist resistance, can be achieved in that the upper head part and the lower head part of the connecting heads, in regions of their vertical outer surfaces, if necessary also in regions of their horizontal outer surfaces that follow, toward the outside, the vertical wall parts that lie against the related vertical support and/or lie opposite to it, at a slight distance, are welded to the related vertical support by way of a continuous weld seam, in each instance, and are also welded to the related perforated disk in regions of their vertical outer surfaces that follow, toward the outside, the horizontal slit surfaces of the slit of the connecting head, in each instance, over the entire width, in each instance, of the part of the related perforated disk that projects into the slit of the connecting head, in each instance, by way of a continuous weld seam, in each instance, and also in regions of the vertical outer surfaces that follow, toward the outside, the vertical slit surfaces of the slit, are welded to the face surfaces of the related perforated disk, situated in the region of the slit, by way of a continuous weld seam, in each instance, if necessary with the exception of at least one liquid run-off opening that is provided, if necessary.

An optimized permanent connection and a vertical frame having optimized stability, particularly anti-twist resistance, can be achieved in that the connecting heads, in the region of all their outer surfaces that follow, toward the outside, their surfaces that lie directly opposite the related vertical support and the related perforated disk, are welded to the related vertical support and to the related perforated disk, if necessary with the exception of at least one liquid run-off opening, by way of a continuous weld seam.

The perforated disks can advantageously have at least three, preferably at least seven, particularly at least eight perforations for connecting holding devices, particularly for suspending supporting and/or connecting elements, preferably of scaffold elements that run horizontally and/or diagonally, for example scaffold cross-bars and/or scaffold diagonals, particularly of a modular scaffold, whereby a perforation, in each instance, can be disposed relative to an adjacent perforation at the same circumference angle, preferably amounting to 45 degrees. In this way, varied advantageous connection possibilities and a defined orientation of the holding devices connected to the perforated disk, in each instance, predetermined by means of a specific angle between the adjacent perforations, in each instance, can be achieved.

In a preferred further development, it can be provided, alternatively or additionally, that the perforations, at least in a perforated disk part of the related perforated disk that is not covered by the connecting head, in each instance, have different sizes, whereby at least two, preferably at least four first perforations of the perforations are larger than a second perforation disposed between two of the larger perforations, in each instance. In this manner, the perforated disks in the perforated disk part of the related perforated disk not covered by the connecting head, in each instance, of the horizontal arm of the vertical frame, in each instance, can be advantageously configured in a manner that is actually known, according to the state of the art, so that in this regard, in particular, one-hundred percent compatibility with the components of a modular scaffold system that can be connected with these perforated disks is guaranteed.

It can furthermore be practical if a perforated disk part of the perforated disk, in each instance, that has a perforation of the perforations, preferably including the entire perforation, projects into the slit of the related connecting head. In this manner, it can be achieved that this one perforation is covered, in each instance, laterally, by outer wall parts of the connecting head, in each instance, thereby making it possible to implement continuous weld seams, in each instance, and accordingly a good connection, particularly in these regions.

It is practical if the said perforation in the perforated disk part covered by the connecting head, in each instance, is a smaller perforation of the perforations having different sizes. In this manner, it can be assured that all the larger perforations of the perforations are available for connecting holding devices, particularly scaffold elements that run diagonally, for example scaffold diagonals, particularly of a modular scaffold.

In a particularly preferred embodiment, it can be provided, alternatively or additionally, that the connecting heads are configured in such a manner, and the related perforated disk, with the slit, in each instance, is configured to at least partly engage over them, in such a manner that with the exception of a single perforation of the perforations of the related perforated disk, all the other perforations of the related perforated disk can be used for connecting holding devices, particularly for suspending usual connecting heads of supporting and/or connecting elements, preferably of scaffold elements that run horizontally and/or diagonally, for example scaffold cross-bars and/or scaffold diagonals, particularly of a modular scaffold.

In particular, a comparatively cost-advantageous production of the vertical frames can be achieved in that the connecting heads of the horizontal arm or of the horizontal arms of the vertical frame are produced by means of forming, particularly by means of compressing or squeezing together the horizontal brace, which is preferably configured as a hollow profile.

According to an advantageous further development, it can be provided that the vertical supports have maximally or only two of the perforated disks, in each instance, of which a first perforated disk, in each instance, is attached in the region of the upper end, and of which a second perforated disk is attached in the region of the lower end of the vertical support, in each instance. In this manner, a vertical frame according to the invention can be made available in cost-advantageous and weight-saving manner, from which particularly stable supporting scaffolds or supporting scaffold towers, if necessary also parts of modular scaffolds that can be combined with them, can be built up in many varied ways.

According to an advantageous first exemplary embodiment of a vertical frame according to the invention, it can be provided that this frame is configured as an equalization frame that allows height equalization, preferably one intended for height equalization, whereby the length of the vertical supports of the equalization frame is smaller than the horizontal distance between the longitudinal axes of the vertical supports, particularly the vertical supports disposed farthest to the outside, of the equalization frame. Such an equalization frame can therefore have a height that is smaller, in comparison with its width, in its position of use or installation. In the case of such an equalization frame, a vertical plane can be spanned by two of its vertical supports and by two of its horizontal arms, which plane can have a rectangular cross-section or outline, particularly a horizontal one. Such horizontal frames can be provided, in particularly advantageous manner, at the lower end and/or at the upper end of a supporting scaffold or a supporting scaffold tower, in order to allow or guarantee a height equalization that might be desired there.

In an advantageous further development, it can be provided that the length of the vertical supports of the equalization frame amounts to about 50 percent to 80 percent, preferably about 60 percent to 70 percent, particularly about 65 percent of the horizontal distance between the longitudinal axes of the vertical supports, particularly of the vertical supports that lie farthest on the outside, of the equalization frame.

In concrete terms, it can be provided that the length of the vertical supports of the equalization frame amounts to about 55 cm to 87 cm, preferably about 85 cm to 76 cm, particularly about 71 cm. In this connection, any pipe connectors that might be present at the upper ends and/or at the lower ends are not included in this calculation.

In a preferred embodiment, it can be provided that the vertical supports of the equalization frame, both in the region of their upper ends and in the region of their lower ends, are equipped with the perforated disks onto which the connecting heads of the first horizontal arms and the connecting heads of the second horizontal arms are welded. It is practical if the vertical supports of the equalization frame are equipped, in each instance, with precisely two perforated disks. In this manner, the cost advantages and/or construction advantages and/or combination advantages already mentioned above can be optimally utilized at a comparatively low weight of the vertical frames.

In a particularly advantageous further development, it can be provided, alternatively or additionally, that the perforated disks attached on one and the same vertical support of the vertical supports of the equalization frame are disposed at a vertical distance of about 50 cm relative to one another. In this manner, the equalization frames can be set up or installed without starting pieces, particularly in such a manner that foot spindles can be directly inserted into the vertical supports of the equalization frame, in each instance, which are configured as pipes, particularly made from steel.

According to another advantageous embodiment of a vertical frame according to the invention, this frame can be configured as a standard frame, whereby the length of the vertical supports of the standard frame is greater than the horizontal distance between the longitudinal axes of the vertical supports, particularly of the vertical supports that lie farthest on the outside, of the standard frame. Such standard frames can be combined, in particularly advantageous manner, in combination with the aforementioned equalization frame, to construct frame supports or stacking tower supports, particularly to construct a supporting scaffold, particularly a falsework, preferably to construct a supporting scaffold tower or falsework tower or stacking tower. In this connection, one or more standard frames disposed one on top of the other and fixed in place relative to one another, in each instance, preferably set onto one another, can be provided, depending on the desired or required height for bracing loads to be supported.

Accordingly, therefore, none, one, or two equalization planes, i.e. height blocks formed with equalization frames, can be built up, as a function of the height of a frame support or stacking tower support that is to be reached, or of the height of a supporting scaffold, particularly of a falsework, that is to be reached, or of the height of a supporting scaffold tower, falsework tower or stacking tower that is to be reached. In the case of an embodiment having only one equalization plane or having only one equalization height block, the equalization frames are preferably situated at the lower end of the construction to be built up. In the case of constructions having two equalization planes or equalization height blocks, it is practical if the second equalization plane or the second equalization height block with equalization frame is situated at the upper end of the construction, as an end. This variant, as well, can advantageously be constructed without starting pieces, in other words only with foot spindles to be inserted, making assembly faster.

Only in the event that corresponding constructions without equalization planes are being built, it is necessary to start with starting pieces, particularly of a modular scaffold, preferably with the known Layher Allround starting pieces.

According to an advantageous first embodiment variant of such a standard frame, a first standard frame can be used, whose vertical supports have a length that amounts to about 120 percent to 160 percent, preferably about 130 percent to 150 percent, particularly about 140 percent, of the horizontal distance between the longitudinal axes of the vertical supports, particularly of the vertical supports that lie farthest on the outside, of the first standard frames.

In concrete terms, it can be provided that the length of the vertical supports of the first standard frame amounts to about 130 cm to 175 cm, preferably about 140 cm to 165 cm, particularly about 150 cm. In this connection, as well, as was already mentioned in connection with the equalization frames, one or more pipe connectors that might be provided are not taken into consideration.

In an advantageous further development of such a first standard frame, it can be provided that its vertical supports are equipped with the perforated disks only in the region of their upper ends, at which the connecting heads of the first horizontal arms of this first standard frame are welded on.

In a particularly preferred embodiment, it can be provided that the vertical supports of the first standard frame, in each instance, are equipped with only a single perforated disk.

According to an advantageous further embodiment of a standard frame as indicated above, this frame can be configured as a second standard frame, whose vertical supports have a length that amounts to about 140 percent to 180 percent, preferably about 150 percent to 170 percent, particularly about 160 percent, of the horizontal distance between the longitudinal axes of the vertical supports, particularly of the vertical supports situated farthest on the outside, of the second standard frame. Such a second standard frame can be assembled and combined, in particularly advantageous manner, with vertical diagonals of a modular scaffold system, particularly of the Layher Allround scaffold system, that are already available at a certain height or length.

In concrete terms, the length of the vertical supports of the second standard frame can amount to about 150 cm to 195 cm, preferably about 165 cm to 185 cm, particularly about 176 cm. Here again, as mentioned above, it holds true that the lengths of any pipe connectors that might additionally be provided are not taken into consideration.

In a particularly advantageous embodiment of such a second standard frame, it can be provided that its vertical supports are not only equipped, in the region of their upper ends, with the perforated disks on which the connecting heads of the first horizontal arms are fixed in place, but also are equipped, in the region of their lower ends, with the perforated disks onto which the connecting heads of the second horizontal arms are welded.

According to a particularly advantageous embodiment of such a second standard frame, its vertical supports can be equipped, in each instance, with precisely two perforated disks.

According to a particularly advantageous embodiment variant, it can be provided, particularly in the case of the equalization frame and/or of the second standard frame, that the perforated disks attached in the region of the lower ends of the vertical supports are at a first distance from the lower ends of these vertical supports, and that the perforated disks attached in the region of the upper ends of their vertical supports are at a second distance from the upper ends of these vertical supports, which distance is the same as the first distance or corresponds to the first distance. In this manner, it is possible to create symmetrical conditions with regard to the upper and lower connection configurations of the vertical supports of such vertical frames. This is advantageous, particularly when building constructions using such "symmetrical" vertical frames, because then it is not important whether or not these vertical frames are connected with the correct sides matching up. This brings with it advantages during installation, and it is also not important in terms of safety which ends of the vertical supports of these vertical frames are facing up or down when they are built up.

According to a particularly advantageous exemplary embodiment, it can be provided that the horizontal distance between the vertical supports or the horizontal distance between the longitudinal axes of the vertical supports of the vertical frame or of the vertical frames amounts to about 109 cm or precisely 1.088 m. This dimension corresponds to a usual system width of a modular scaffold system, particularly of the Layher Allround scaffold system, so that optimal combinability is guaranteed.

Preferably, the vertical supports of the vertical frames, preferably also the horizontal arms of the vertical frames, can be configured, in each instance, with round pipes having an outside diameter. This outside diameter can preferably amount to about 48.3 mm. This outside diameter corresponds to a standard scaffold pipe diameter, so that it is possible to use such standard scaffold pipes for the production of the vertical supports or vertical posts, and, if necessary also of the horizontal braces of the vertical frames according to the invention, in advantageous manner, resulting in the corresponding cost advantages.

The diagonal rod or the diagonal rods of the vertical frames, as well, can advantageously be configured with a round pipe. The round pipe can preferably be compressed at its ends, to form flat connectors, which can be configured with double-wall parts that lie against one another or opposite one another. Such flat connectors or pipe ends of the diagonal rods can be welded, in particularly simple manner, onto two of the horizontally spaced-apart vertical supports of the vertical frame or on two of the vertically spaced-apart horizontal arms of the vertical frame or both on a vertical support of the vertical supports of the vertical frame and onto a horizontal arm of the horizontal arms of the vertical frame. In a preferred embodiment, only a single diagonal rod is provided per vertical frame. Furthermore, according to a preferred embodiment, it can be provided that this one or more or all the diagonal rods are welded on in the region of their ends, in each instance, onto two of or the two horizontally spaced-apart vertical supports of the vertical frame.

The outside diameter of the round pipe of the diagonal rod or the diagonal rods, particularly in contrast to the outside diameter of the round pipes of the vertical supports, if applicable also of the horizontal arms of the vertical frame, can amount to about 33.7 mm.

In order to increase the supporting load of constructions built up from vertical frames according to the invention, embodiments can be provided in which multiple vertical frames according to the invention are coupled with one another in parallel-parallel manner. Accordingly, it can be provided that one or more of the same vertical frames are coupled with one another in parallel-parallel manner, on a vertical frame according to the invention, using connecting head devices, preferably in the form of double connecting heads, particularly in the form of double wedge heads, for example using such connecting head devices that have at least two connecting head units connected with one another, for connecting to the perforated disks, as they are disclosed in DE 299 06 742 U1 or the parallel EP 1 045 088 A1. Corresponding to the constructions disclosed in the aforementioned patents, it is understood that aside from such "doubled" vertical frames, or vertical frames coupled with one another in parallel-parallel manner, it is also possible to provide additional posts provided with perforated disks, in the corner region, which posts also are or can be coupled with the vertical supports of the vertical frame or the vertical frames, additionally or alternatively, using connecting head devices, preferably in the form of double connecting heads, particularly in the form of double wedge heads, for example using such connecting head devices that have at least two connecting head units that are connected with one another, for connecting to the perforated disks, as they are disclosed in the patents mentioned above.

The invention also relates to a frame support, particularly a stacking tower support, having at least two vertical frames according to the invention, disposed one on top of the other, and fixed in place relative to one another, particularly set onto one another.

The invention furthermore relates to a supporting scaffold, particularly a falsework, having at least one or at least two vertical frames according to the invention, or having at least one frame support according to the invention.

In a preferred embodiment of such a supporting scaffold, it can be provided that this is formed with at least two of the vertical frames according to the invention, disposed one on top of the other and fixed in place relative to one another, particularly set onto one another, whereby the distance of at least one perforated disk disposed in the region of the upper end of the vertical support of a lower, first vertical frame of the at least two vertical frames according to the invention from the perforated disk disposed in the region of the upper end of the vertical support of an upper, second vertical frame coupled with, preferably set into, this vertical support of the first vertical frame of these at least two vertical frames according to the invention amounts to about 100 cm or 150 cm or 200 cm. This allows particularly advantageous connection possibilities and combinations with components of a modular scaffold, particularly of the Layher Allround scaffold system.

In the case of the aforementioned supporting scaffold, it is advantageous if the lower, first vertical frame is a or the equalization frame or a or the first standard frame, and the upper, second vertical frame is another or the first standard frame.

According to an alternative solution idea or according to a preferred embodiment, it can be provided, i.e. the invention relates to a three-dimensional, modular supporting scaffold, particularly falsework, which is built up from at least two, preferably precisely two, preferably similar or identical closed vertical frames disposed at a horizontal distance from one another, particularly according to the invention, and from at least two scaffold diagonals that reinforce the supporting scaffold, preferably also from at least two horizontal scaffold cross-bars, particularly disposed in the region of the plane of the scaffold diagonals, in each instance, forming a polygonal, preferably quadragonal, particularly rectangular or square outline, whereby the at least two scaffold diagonals, preferably also the horizontal scaffold cross-bars, if they are provided, connect the at least two vertical frames, in each instance, and whereby the at least two scaffold diagonals, preferably also the horizontal scaffold cross-bars, if they are provided, are disposed transverse, in each instance, to the vertical supports of the at least two vertical frames and at a horizontal distance from one another, and whereby the at least two scaffold diagonals, preferably also the horizontal scaffold cross-bars, if they are provided, are releasably attached, in each instance, to these at least two vertical frames, whereby these at least two scaffold diagonals are vertical diagonals that extend vertically, preferably in a vertical plane, particularly in a vertical plane that is spanned perpendicular to one of the at least two vertical supports of one of the vertical frames of the at least two vertical frames, whereby at least two of the vertical frames, in each instance, comprise at least two, preferably precisely two, particularly parallel, vertical supports, which are disposed at a horizontal distance from one another, whereby these at least two vertical frames, in each instance, comprise at least two, preferably precisely two, particularly parallel, horizontal arms, which are disposed at a vertical distance from one another, and whereby the at least two horizontal arms extend, in each instance, between two, in each instance, of the vertical supports of the vertical frame, in each instance, of these at least two vertical frames, transverse, preferably perpendicular, to these vertical supports, and whereby a first horizontal arm of these at least two horizontal arms is welded on, at both ends, to one of the vertical supports, in each instance, in the region of their upper end, and whereby a second horizontal arm of these at least two horizontal arms is welded on, at both ends, to these two vertical supports, in the region of their lower ends, and whereby these at least two vertical frames are reinforced, in each instance, with at least one, preferably with a single or only with a first and a second, diagonal rod, which extends, in each instance, between two of the vertical supports and two of the horizontal arms, preferably the first horizontal arm, in each instance, and the second horizontal arm, in each instance, of the vertical frame, in each instance, whereby the diagonal rod or the diagonal rod, in each instance, is welded onto two of the vertical supports or to two of the horizontal arms or both to a vertical support of the vertical supports and to a horizontal arm of the horizontal arms of the vertical frame, whereby in the region of the upper end, in each instance and/or in the region of the lower end, in each instance, at least two, in each instance, of the vertical supports of these at least two vertical frames, preferably of the vertical supports disposed at the outer ends of the supporting scaffolds, if necessary also at all the vertical supports of the vertical frame, a perforated disk, in each instance, provided with multiple perforations, for connecting holding devices, particularly for suspending supporting and/or connecting elements, preferably scaffold elements that run horizontally and/or diagonally, for example scaffold cross-bars and/or scaffold diagonals, particularly of a modular scaffold, is permanently attached, preferably by means of welding, which disk is disposed concentric to the vertical support, in each instance, and surrounds the vertical support, in each instance, in flange-like manner, whereby the first horizontal arm and/or the second horizontal arm, in each instance, comprise(s) a, preferably a single, particularly straight, horizontal brace, which is configured or provided, at its ends that face away from one another, in each instance, with a connecting head formed in one piece or multiple pieces with the horizontal brace, and whereby the connecting head, in each instance, is delimited with side wall parts that have vertical outer surfaces that run, in wedge-like manner, toward a center, particularly toward a post and disk center of the related perforated disk, which surfaces enclose a wedge angle that amounts to particularly 40 degrees to 50 degrees, preferably about 45 degrees, particularly 44 degrees, whereby the connecting head, in each instance, has an upper head part and a lower head part, which are connected with one another, preferably in one piece, particularly configured uniformly, and whereby a slit that is open toward the related vertical support is provided between the upper head part and the lower head part, with which slit the connecting head, in each instance, is set onto the perforated disk, in each instance, which projects at least partly into it, and whereby the connecting head, in each instance, particularly in this set-on position, is welded onto the vertical support, preferably onto the perforated disk.

In the case of these supporting scaffolds, i.e. the ones discussed in this patent, it can advantageously be provided that the vertical diagonals and/or the horizontal scaffold cross-bars that might be provided have a first connecting head at a first end, in each instance, and a second connecting head at a second end that faces away from this end, in each instance, whereby these vertical diagonals and/or these horizontal scaffold cross-bars that might be provided are releasably attached, in each instance, by means of the first connecting head provided at their first end, in each instance, to a first perforated disk attached in the region of the end of the vertical support of a first vertical frame, according to the invention, of the at least two vertical frames according to the invention, and whereby the vertical diagonals and/or the horizontal scaffold cross-bars that might be provided are releasably attached, in each instance, by means of the second connecting head provided at their second end, in each instance, to a second perforated disk attached in the region of an end of the vertical support of a second vertical frame spaced apart horizontally from the first vertical frame, of the at least two vertical frames. As an alternative to the characteristics last mentioned, it can be provided that the vertical diagonals, in each instance, are releasably attached to a second perforated disk, by means of the second connecting head provided at their second end, in each instance, which disk is attached to a vertical support coupled with a vertical support of a second vertical frame of the at least two vertical frames or a starting piece, whereby the horizontal scaffold cross-bars that might be provided then are releasably attached to a second perforated disk or a starting piece in the region of an end of the vertical support of the second vertical frame spaced horizontally apart from the first vertical frame, of the at least two vertical frames. Preferably, it can be provided, in addition, that the first connecting head and the second connecting head of the vertical diagonals and/or of the horizontal scaffold cross-bars that might be provided, are releasably attached, in each instance, by means of a releasable wedge, to the perforated disk, in each instance, which wedge engages, in this connection, through a perforation of the perforated disk, in each instance, preferably also through a wedge opening, particularly through two wedge openings that lie vertically one on top of the other, of the connecting head, in each instance.

In an advantageous further development, it can be provided that the first connecting head and the second connecting head of the vertical diagonals and/or of the horizontal scaffold cross-bars that might be provided, have an upper head part and a lower head part, in each instance, which parts are connected with one another, preferably in one piece, particularly configured in one piece, and whereby a slit that is open toward the related vertical support and toward the vertical outer surfaces is provided between the upper head part and the lower head part, by way of which slit the connecting head, in each instance, is set onto the perforated disk that projects at least partly into the slit, and whereby the upper head part, in each instance, has a first wedge opening, and the lower head part, in each instance, has a second wedge opening, and whereby the connecting head, in each instance, is fixed in place on the vertical support, in each instance, by means of the wedge, in each instance, that engages, in each instance, through a perforation of the perforated disk, in each instance, and through the two wedge openings.

Alternatively or additionally, it can furthermore be provided that the first connecting head and the second connecting head of the vertical diagonals and/or the horizontal scaffold cross-bars that might be provided is delimited, in each instance, with side wall parts that have vertical outer surfaces that run, in wedge-like manner, toward a center, particularly toward a post and disk center of the related perforated disk, which surfaces enclose a wedge angle that amounts to particularly 40 degrees to 50 degrees, preferably about 45 degrees, for example 44 degrees.

Alternatively or additionally, it can be provided that the connecting heads, as discussed in this patent, of the vertical frames, are provided, in each instance, with system wall parts that have contact surfaces for making contact with the related vertical brace, whereby preferably, in each instance, the upper head part has an upper contact surface, and the lower head part has a lower contact surface.

In this connection, it can be provided that the distances of the upper end of the upper contact surface and of the lower end of the lower contact surface from the horizontal plane that intersects the slit at the height of half the slit width are the same size.

Alternatively or additionally, it can be provided that the longitudinal axis of the horizontal arm is disposed in the region of the height of the slit, preferably in the region of the height between the horizontal slit surfaces of the slit, particularly about at the height of the horizontal plane that intersects the slit at the height of half the slit width.

Alternatively or additionally, it can furthermore be provided that the connecting heads of the vertical frames have a greater height in the region of the wall parts that lie directly opposite the related vertical support, particularly in the region of the contact surfaces of the contact wall parts, than the height or the outside diameter of the horizontal brace, in each instance.

Alternatively or additionally, it can be provided that both the upper end of the upper head part and the lower end of the lower head part of the connecting head, in each instance, of the vertical frames, in the region of the wall parts that lie directly opposite the related vertical support, particularly in the region of the contact surfaces of the contact wall parts, of the horizontal brace, project transversely in one direction, preferably viewed perpendicular to its longitudinal axis.

Alternatively or additionally, it can be provided that the height of the upper head part and/or the height of the lower head part of the connecting heads decreases in the direction toward the horizontal brace, preferably to the outside diameter or the height of the horizontal brace.

Alternatively or additionally, it can be provided that an upper outer surface of the upper head part and/or a lower outer surface of the lower head part of the connecting head, in each instance, is/are configured to be inclined toward the horizontal brace, and preferably enclose(s) an angle, with an imaginary line that runs parallel to the longitudinal axis of the horizontal brace, that amounts to greater than 0 degrees, preferably between 10 degrees and 35 degrees, particularly about 25 degrees.

Alternatively or additionally, it can be provided that the vertical wall parts of the connecting head, in each instance, that lie directly opposite the vertical support, preferably lying against it, have a partly cylindrical shape and, viewed in a cross-section perpendicular to the longitudinal axis of the related vertical brace, are configured with an outside radius corresponding to the vertical brace and amounting to preferably about 24.15 mm.

Alternatively or additionally, it can be provided, according to a particularly advantageous further development, that the connecting head, in each instance, is configured symmetrical to a vertical plane that contains the longitudinal axis of the horizontal brace.

Alternatively or additionally, it can preferably be provided that the connecting head, in each instance, is configured symmetrical to a horizontal plane that intersects the slit at the height of half the slit width.

The invention also relates to a supporting scaffold tower, particularly a falsework tower, having at least one vertical frame according to the invention or having at least two vertical frames according to the invention or having at least one supporting scaffold according to the invention.

It is understood that the characteristics indicated above can be combined individually or in groups, as desired, within the scope of feasibility.

Other characteristics, advantages and aspects of the invention can be derived from the following description part, in which advantageous exemplary embodiments of the invention are described using the figures.

Figure 2:
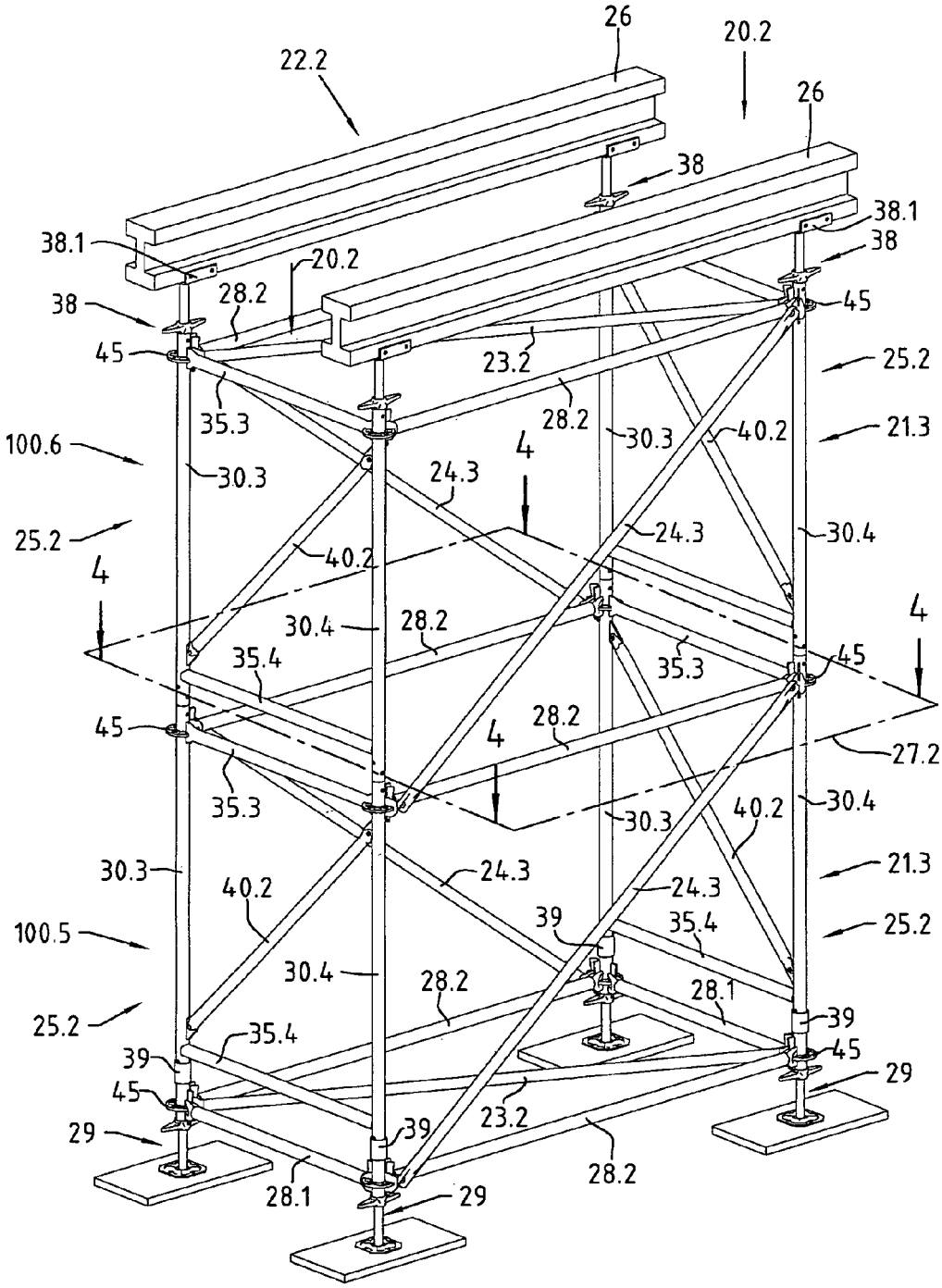
Figure 3:
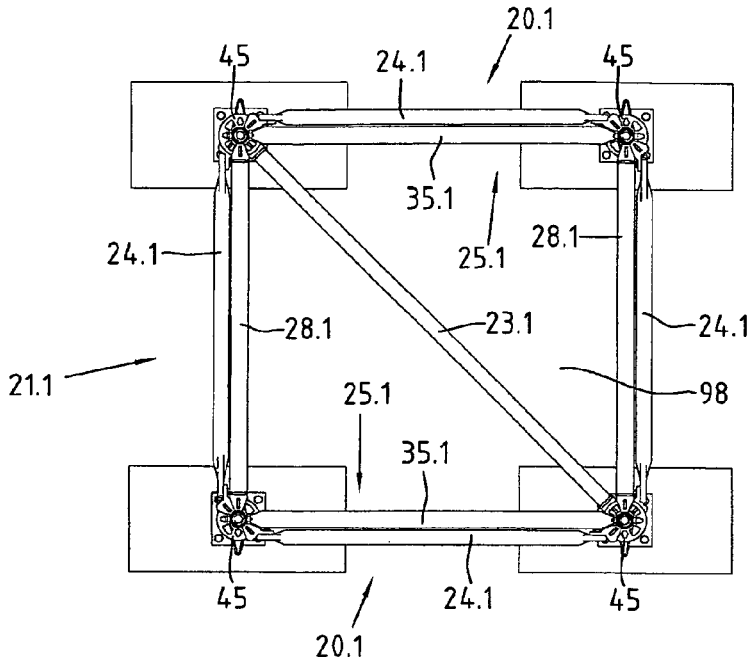
Figure 4:
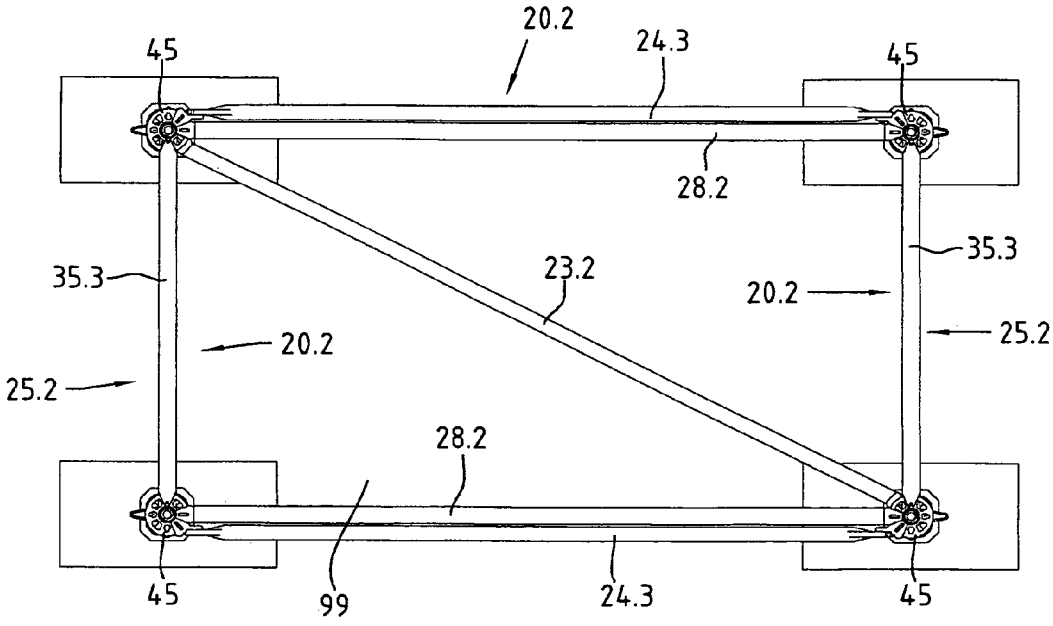
Figure 5:
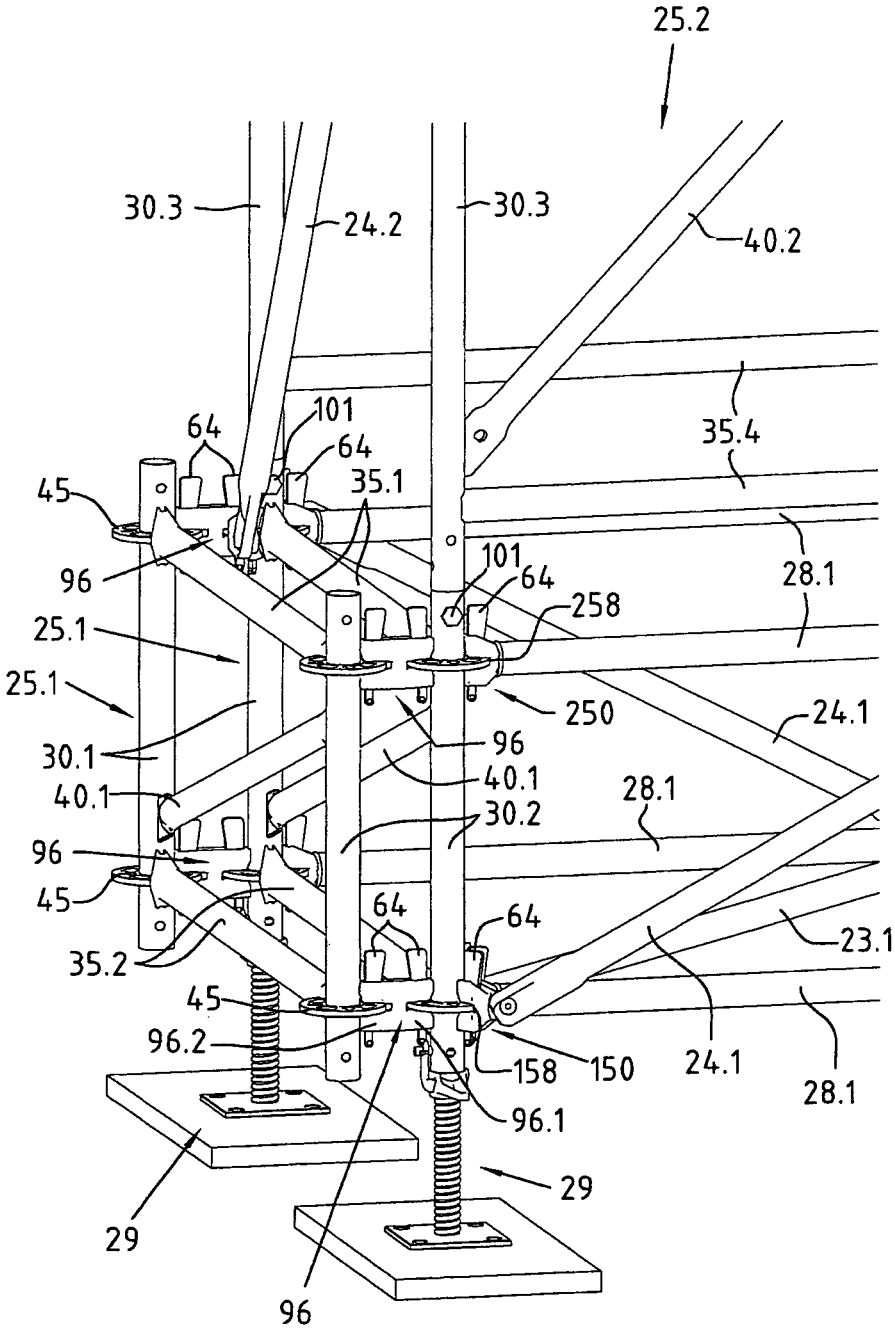
Figure 6:
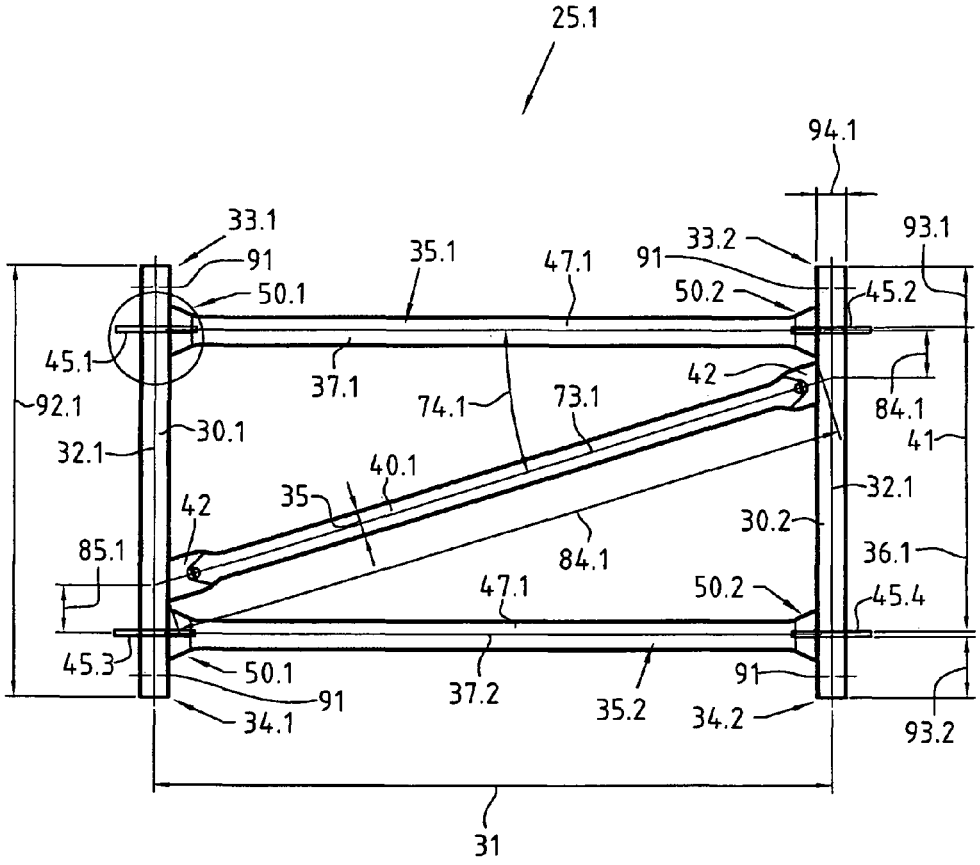
Figure 7:
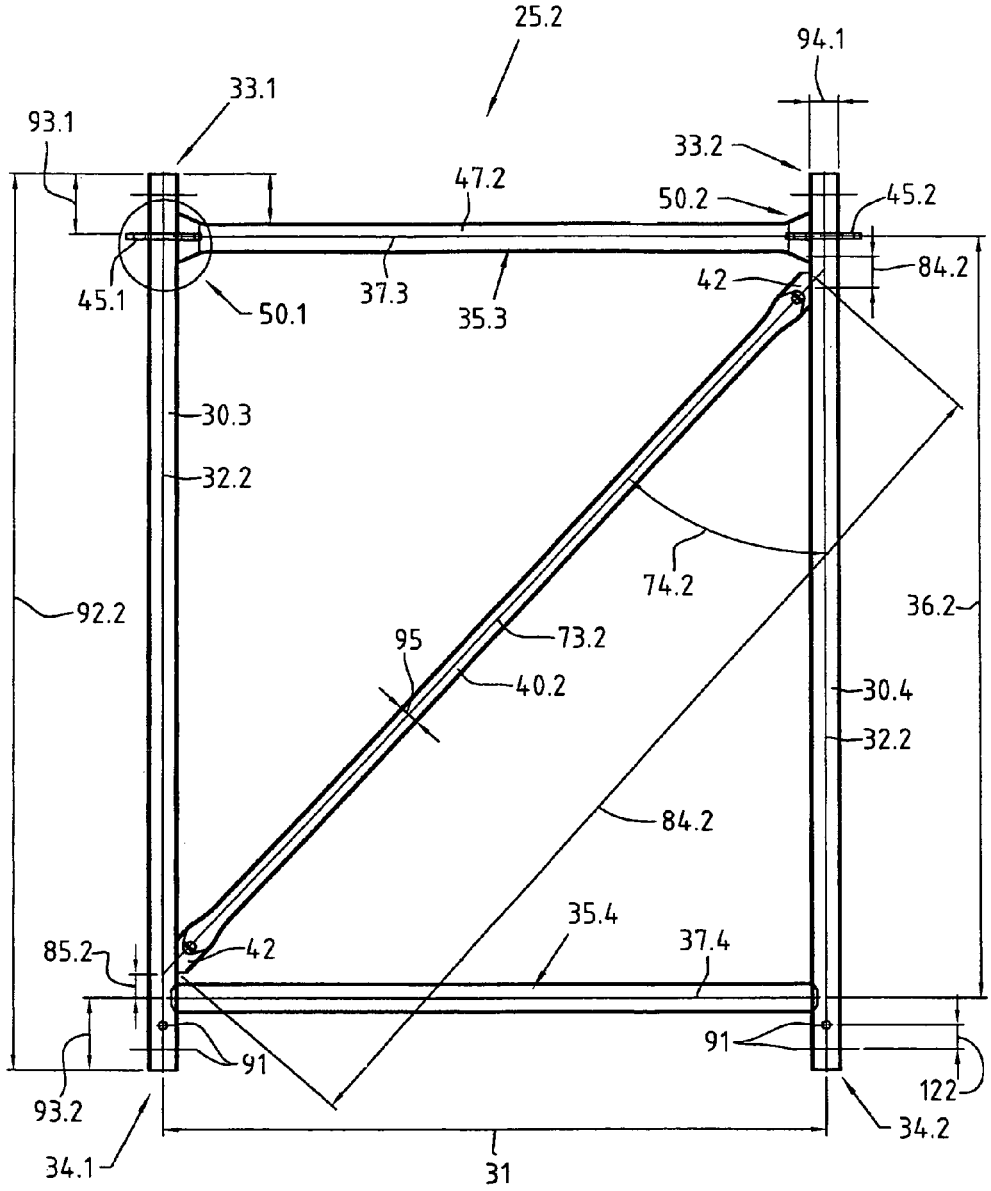
Figure 8:
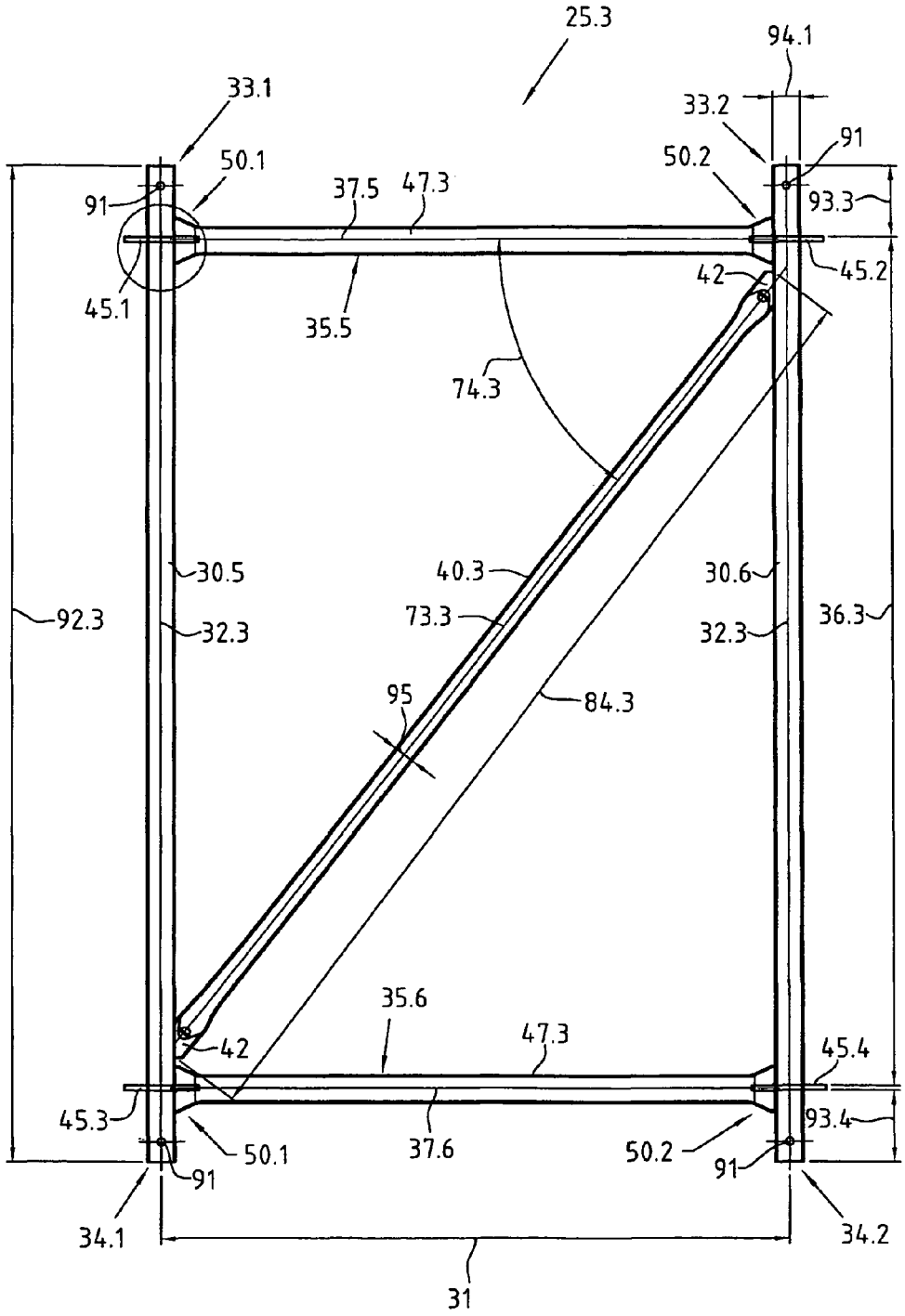
Figure 9:
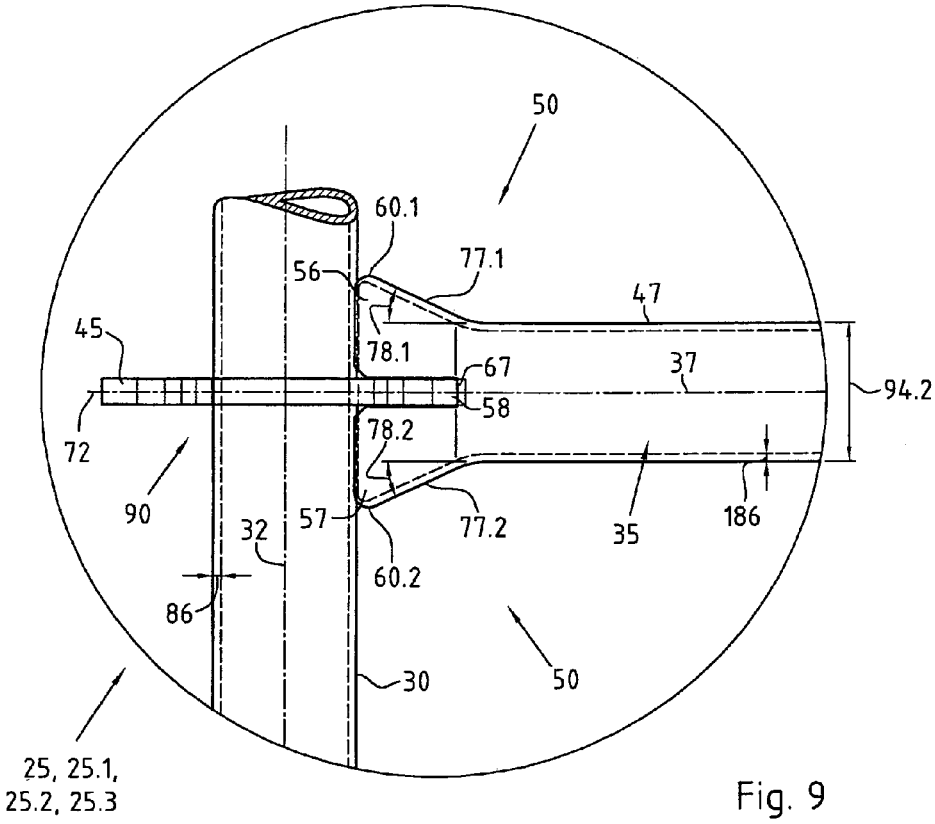
Figure 10:
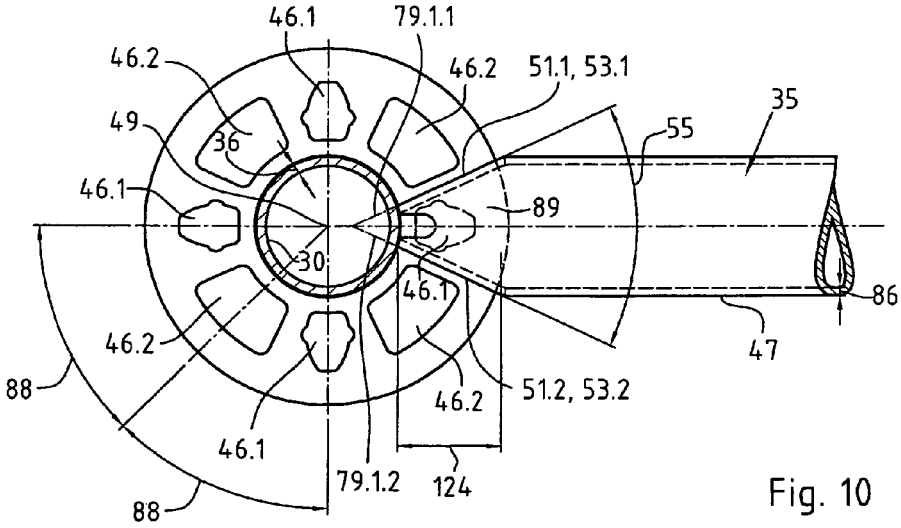
Figure 11:
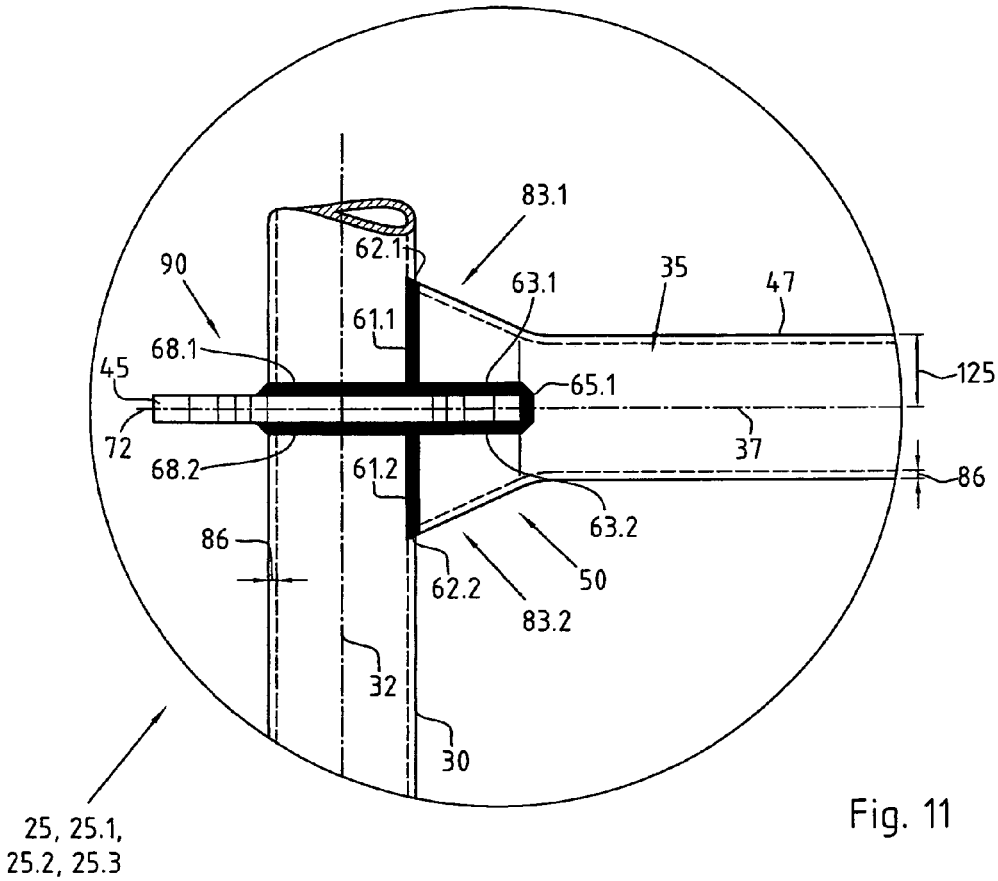
Figure 12:
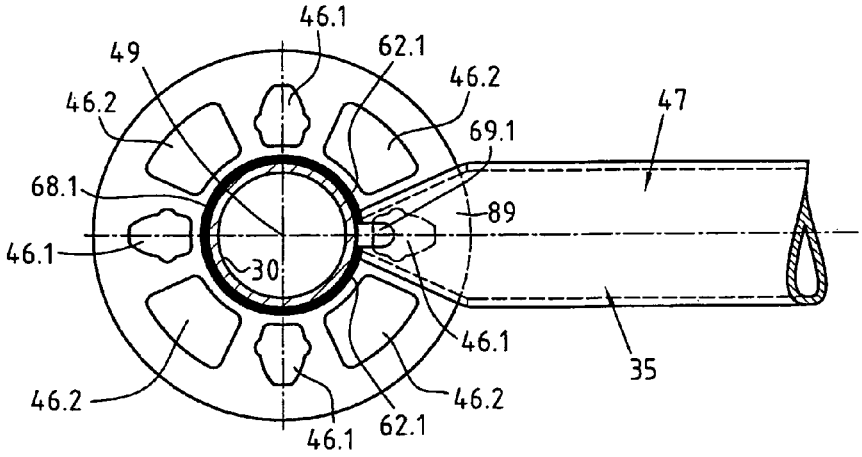
Figure 13:
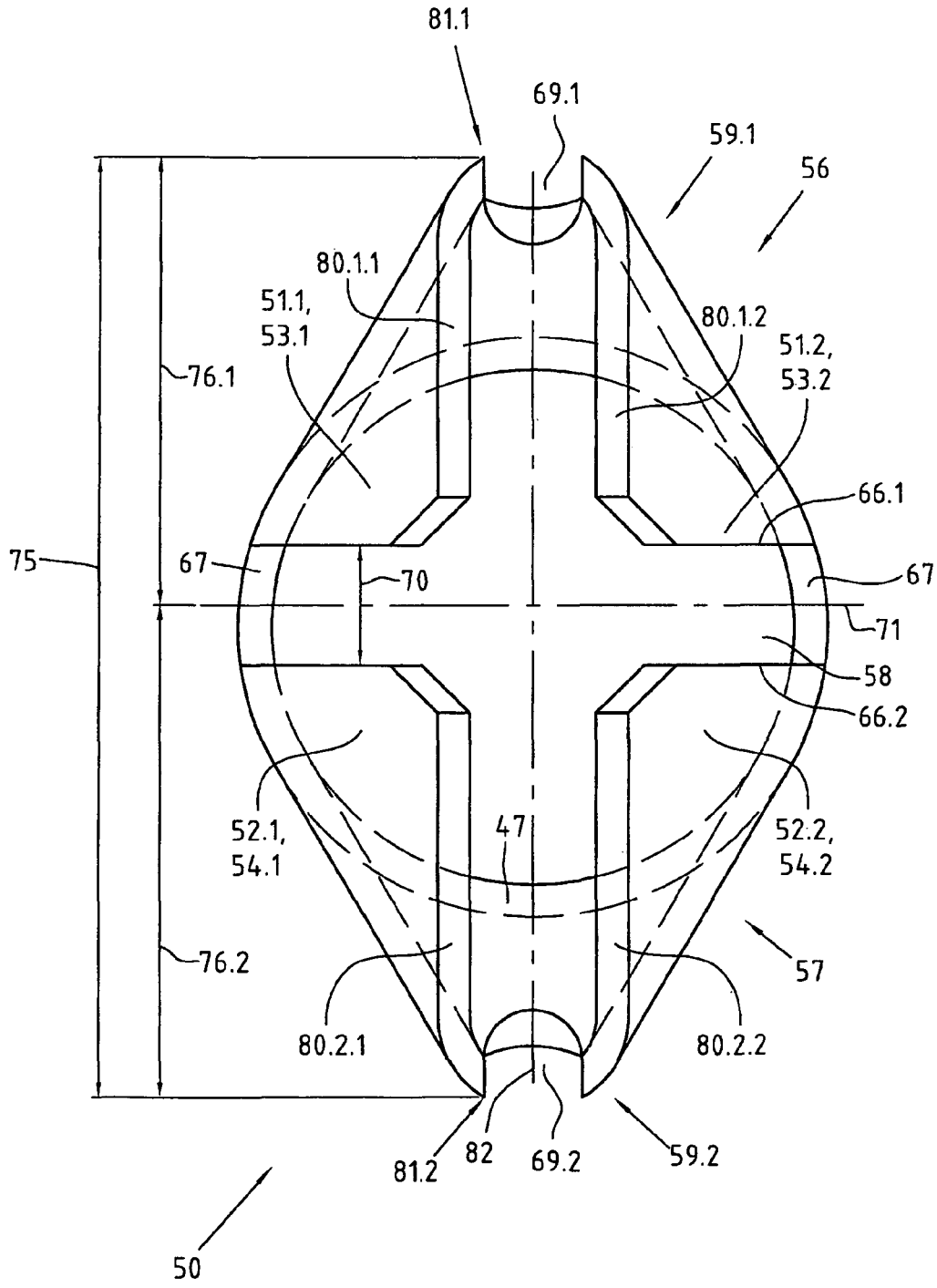
Figure 14:
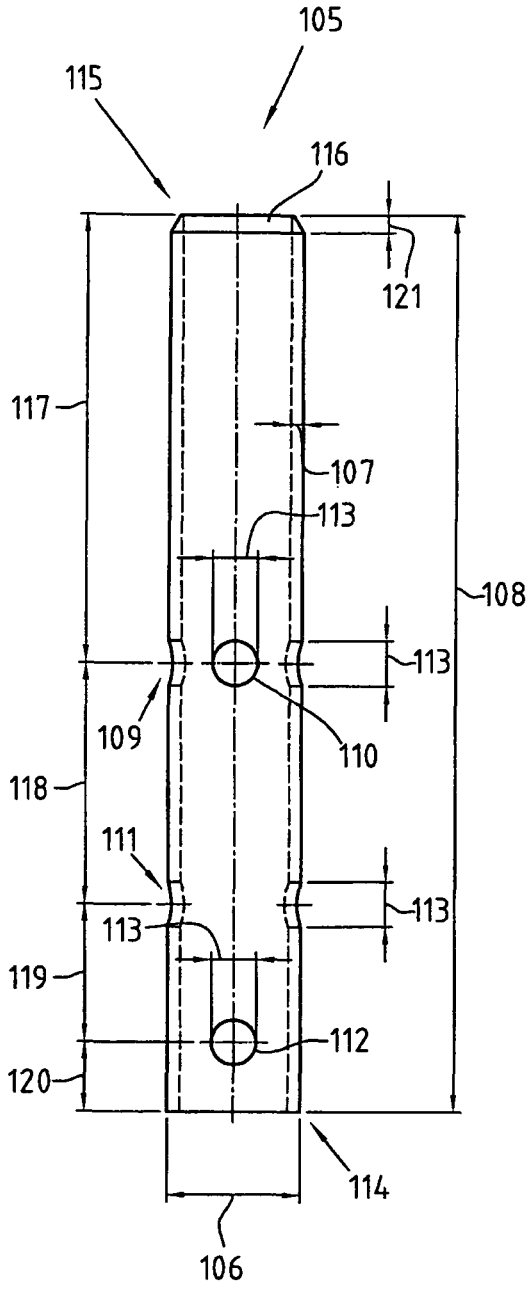

These show:

FIG. 1 a supporting scaffold according to the invention, which is constructed as a supporting scaffold tower according to the invention, having a square outline, and is constructed with a plurality of here eight vertical frames according to the invention, in a three-dimensional representation;

FIG. 2 another supporting scaffold according to the invention, which is constructed as another supporting scaffold tower according to the invention, having a rectangular outline, which is constructed with a plurality of here four vertical frames according to the invention, in a three-dimensional representation;

FIG. 3 a cross-section of the construction according to FIG. 1, in a horizontal section along the section lines 3-3;

FIG. 4 a cross-section of the construction according to FIG. 2 in a horizontal section along the section lines 4-4;

FIG. 5 a detail of a supporting scaffold according to the invention, which is constructed as a supporting scaffold tower according to the invention, which is constructed with a vertical frame arrangement composed of two parallel-parallel coupled, similar or identical vertical frames according to the invention, in a three-dimensional representation;

FIG. 6 a vertical frame according to the invention, which is configured or serves as an equalization frame, in a top view;

FIG. 7 another vertical frame according to the invention, which is configured or serves as a standard frame, also called a first standard frame, in a top view;

FIG. 8 another vertical frame according to the invention, which is configured or serves as a standard frame also called a second standard frame, in a top view;

FIG. 9 an enlarged side view in a region of a connection node of those connection nodes that are marked with a circle in FIGS. 6 to 8, top left, in each instance;

FIG. 10 a partial top view of a vertical frame in the region marked according to FIG. 9, with a vertical support in a sectional representation;

FIG. 11 a representation corresponding to FIG. 9, but now with weld seams emphasized in the node region, with thick black lines;

FIG. 12 a representation corresponding to FIG. 10, but now with weld seams emphasized in the node region, with thick black lines;

FIG. 13 a front view of a connecting head, which is formed on, in one piece, onto a horizontal brace configured with a round pipe, in an unwelded state;

FIG. 14 a side view of a pipe connector for connecting two vertical frames according to the invention.

FIG. 1 shows a first exemplary embodiment of a supporting scaffold 21.1, according to the invention, which is constructed as a supporting scaffold tower 22.1 according to the invention, according to a first exemplary embodiment. This supporting scaffold 21.1 or this supporting scaffold tower has a square outline 98 (FIG. 3). The supporting scaffold tower 22.1 is constructed from frame supports 20.1, 20.1 according to the invention, according to a first exemplary embodiment.

These constructions are based on the use of multiple vertical frames 25; 25.1, 25.2 according to the invention. These are disposed in pairs, in each instance, at a horizontal distance from one another, which distance is determined here by the length of a horizontal transverse cross-bar or scaffold cross-bar 28.1 provided with known connecting heads 250 of a modular scaffold system, here of the Layher Allround scaffold system. This horizontal distance of the two vertical frames 25; 25.1, 25.2, in each instance, relative to one another, corresponds here to the horizontal distance 31 of the longitudinal axes 32; 32.1, 32.2 of the parallel vertical supports 30; 30.1, and 30.2; 30.3 and 30.4 of the vertical frames 25.1, 25.2, in each instance (cf. FIGS. 6 and 7).

So-called height blocks 100; 100.1, 100.2, 100.3, 100.4, 100.5, 100.6 are formed with two of these similar or identical vertical frames 25; 25.1, 25.2, disposed in pairs, in each instance. The first height block 100.1, which is assigned to the ground, is configured as a so-called equalization height block 100.1. This block is constructed with two vertical frames 25.1, 25.1, which are horizontally spaced apart and serve as equalization frames 25.1, 25.1, with two vertical diagonals 24.1, 24.1 that connect them, as well as with two horizontal scaffold cross-bars or transverse cross-bars 28.1, 28.1, disposed in the region of the vertical plane spanned thereby, in each instance, also connecting the two vertical frames 25.1, 25.1.

The vertical diagonal 24.1, 24.1, in each instance, and the scaffold cross-bar 28.1, 28.1, in each instance, are known scaffold components of a modular scaffold, here of the Layher Allround scaffold system. Accordingly, each vertical diagonal 24.1, 24.1 has a known connecting head 150 at its two ends, which is attached to the diagonal brace in articulated manner, and which has a slit 158 formed between an upper head part 156 and a lower head part 157, by way of which slit the connecting head 150, in each instance, is set onto one of the two perforated disks 50 provided on the vertical support 30.1, 30.2, in each instance, of the equalization frame 25.1, 25.1, in each instance. The connection of the vertical diagonals 24.1, 24.1 to the two equalization frames 25.1, 25.1 takes place in known manner, using a releasable wedge 65, in each instance, which is inserted through an upper wedge opening 153.1 and a lower wedge opening 153.2 of the connecting head 150, in each instance, of the vertical diagonals 24.1, 24.1, in order to brace the components to be connected, and is clinched in place, preferably using a hammer (FIG. 5).

The scaffold cross-bars 28.1, 28.1 also have a known connecting head 250 at their two ends, in each instance. This head is welded in place on the rod or scaffold pipe, in each instance, in known manner. This connecting head 250, as well, has an upper head part 256 and a lower head part 257, between which a slit 258 is provided, by way of which the connecting head 250, in each instance, is set onto one of the two perforated disks 45 provided on the vertical support 30.1, 30.2, in each instance, of the equalization frame 25.1, 25.1, in each instance. The connection of the scaffold cross-bar 28.1, 28.1 with the two equalization frames 25.1, 25.1 again takes place in known manner, using a releasable wedge 65, in each instance, which is inserted through an upper wedge opening 253.1 and a lower wedge opening 253.2 of the connecting head 250, in each instance, of the scaffold cross-bar 28.1, 28.1, in order to brace the components to be connected, and clinched in place, preferably using a hammer (see FIG. 5).

For the purpose of a diagonal reinforcement of the supporting scaffold 21.1 or of the supporting scaffold tower 22.1 constructed from it, in a horizontal plane, another scaffold cross-bar in the form of a horizontal diagonal 23.1 is furthermore provided in the equalization height block 100.1, which is attached between two of the lower perforated disks 45, which lie opposite one another, of the two equalization frames 25.1, 25.1, using connecting heads 250. Except for their length, the horizontal diagonal 23.1 has the same configuration, in each instance, as the scaffold cross-bar 28.1.

As is evident from FIG. 1, the lower ends 34.1, 34.2 of the four vertical supports 30.1, 30.2 of the two equalization frames 25.1, 25.1 are inserted, in each instance, into a known foot spindle 29, by means of which a precision height adjustment, in each instance, and consequently an alignment of the supporting scaffold 21.1 or of the said first lower height block 100.1 can be achieved.

Above the first height block 100.1 formed with the two equalization frames 25.1, 25.1, here three additional height blocks 100.2 to 100.4 are built up, whereby the height block 100.4 provided in the region of the upper end of the supporting scaffold 21.1 or of the supporting scaffold tower 22.1 again is configured as an equalization height block 100.4. This upper equalization height block 100.4 is constructed with essentially the same components of the lower equalization height block 100.1, so that in this regard, reference can be made to the above explanations. In contrast to this, in the case of the upper equalization height block 100.4, the horizontal diagonal 23.1 provided for horizontal reinforcement is fixed in place on two of the upper perforated disks 45 that lie diagonally opposite one another, by way of its connecting head 250. Furthermore, in the case of this upper height block 100.4, the two equalization frames 25.1, 25.1 are coupled only by way of the perforated disks 45 provided at their upper ends, in each instance, by way of two of the scaffold cross-bars 28.1.

It is understood that such a supporting scaffold or such a supporting scaffold tower, which is constructed with a square outline 98, can also be constructed with only one equalization height block, preferably a lower equalization height block 100.1, or leaving out any equalization height blocks.

The two additional height blocks 100.2 and 100.3 provided in FIG. 1 between the two equalization height blocks 100.1 and 100.4 are constructed, in each instance, with vertical frames 25.2, 25.2 according to the invention, referred to as first standard frames 25.2, 25.2. These vertical frames 25.2 differ from the equalization frames 25.1 essentially in that they have only one perforated disk 45, in each instance, in the region of the upper ends 33.1, 33.2, in each instance, of their vertical supports 30.3, 30.4, and furthermore in that these vertical frames 25.2, 25.2 have a greater height 92.3 (see FIG. 7). With regard to the design details of the equalization frame 25.1, on the one hand, and of the first standard frame 25.2, on the other hand, reference can be made to the further explanations regarding FIGS. 6 and 7.

The construction of the second height block 100.2 with the two first standard frames 25.2, 25.2, in each instance, takes place here to increase the overall stability, in such a manner that the two standard frames 25.2, 25.2 of the second height block 100.2 are disposed offset relative to one another by 90 degrees, as compared to the two equalization frames 25.1, 25.2 of the first height block 100.1, about a vertical central axis, in each instance. In similar manner, as in the case of the equalization frames 25.1, 25.1, the two standard frames 25.2, 25.2 are connected with one another using two vertical diagonals 24.2, 24.2, whereby these vertical diagonals 24.2, 24.2, in comparison with the vertical diagonals 24.1, 24.1 of the equalization frames 25.1, 25.1, have a greater length, but otherwise have the same structure as the vertical diagonals 24.1.

The connection of the two standard frames 25.2, 25.2 of the second height block 100.2, using the two vertical diagonals 24.2, 24.2, takes place in such a manner that each of the vertical diagonals 24.1 is fixed in place, with a first connecting head 150, in each instance, in the region of the upper end 33.1, 33.2 of the vertical supports 30.3, 30.4 of the standard frame 25.2, 25.2, in each instance, while the other connecting head 150, in each instance, of the vertical diagonals 24.2, 24.2, is fixed in place in the region of the upper end 33.1, 33.2 of a vertical support 30.1, 30.2 of one of the equalization frames 25.1, 25.1. The distance of the perforated disks 45 attached to the vertical supports 30.3, 30.4 of the first standard frames 25.2, 25.2 from the vertical support of the equalization frame 25.1, in each instance, connected up with the said vertical support of the first standard frame 25.2, in the region of the upper end, amounts to 150 cm here. In other words, the said two perforated disks 45, 45 have a vertical distance 97 of 1.5 m over the frame stack. The advantage of this grid dimension of 1.5 m is that so-called standard-production diagonals of a modular scaffold system, here the Layher Allround scaffold system, can be used in cost-advantageous manner.

As is evident from FIG. 1, another horizontal scaffold cross-bar 28.1 is fixed in place there, between the two vertical frames or standard frames 25.2, 25.2 of the height block 100.2, specifically between the horizontally spaced-apart perforated disks 45 of the vertical frames 25.2, 25.2 that lie opposite one another at a horizontal distance. The provision of one or two such scaffold cross-bars 28 is optional. By means of the installation of this or such additional horizontal scaffold cross-bars 28.1, it is possible to advantageously further reinforce the supporting scaffold 21.1 or the supporting scaffold tower 22.1. Furthermore, such additional scaffold cross-bars 28.1, 28.1 can be used for bracing or support of scaffold platforms 43. Two such scaffold platforms are shown as examples in FIG. 1. Here, these are laid onto the transverse cross-bars or scaffold cross-bars 28.1, 28.1, which are configured as round pipes here, using suspension hooks 44 that are U-shaped in cross-section. In this or similar manner, a supporting scaffold 21 according to the invention or a supporting scaffold tower 22 according to the invention can additionally be used also as a work scaffold or the like.

On the second height block 100.2, as is also evident from FIG. 1, another height block 100.3 is built up, which again contains two horizontally spaced-apart vertical frames 25, here in the form of first standard frames 25.2, 25.2. These two vertical frames 25.2, 25.2, again, are disposed offset relative to the two vertical frames 25.2, 25.2 disposed in the height block 100.2 that is situated underneath, by 90 degrees about the central longitudinal axis or height axis of the supporting scaffold 21.1 or of the supporting scaffold tower 22.1. For the remainder, the structure of the height block 100.3 corresponds to the height block 100.2.

For bracing the loads to be supported by the vertical frame 25 according to the invention or the frame support 20 according to the invention or the supporting scaffold 21 according to the invention or the supporting scaffold tower 22 according to the invention, a known head spindle 38, in each instance, can be provided on the upper end, in each instance, of the vertical supports 30 of the equalization frame 25.1, 25.2 provided with the uppermost height block 100.4, which spindles, here again, can be inserted into the scaffold pipes of the vertical supports 30 of the equalization frames 25.1, 25.1, configured as round pipes made of steel. These head spindles 38, again in known manner, can be provided with supports 38.1 that are U-shaped in cross-section, for support or accommodation of load beams or form board beams, here in the form of I-beams 26. It is understood that the head spindles can also be configured to support and/or accommodate other supporting bodies, for example in the form of cross-head spindles, in which a support plate and multiple horizontally spaced-apart supporting profiles that proceed from it and extend upward can be provided in the region of their upper ends.

FIG. 2 shows a second exemplary embodiment of a supporting scaffold 21.2 according to the invention. This is constructed as a supporting scaffold tower 22.2 according to the invention, according to a second exemplary embodiment, and has a rectangular outline 99 (FIG. 4). The supporting scaffold tower 22.2 is constructed from frame supports 20.2 according to the invention, according to a second exemplary embodiment. These constructions, as well, are based on the use of multiple vertical frames 25.2, 25.2 according to the invention, here the same or identical, in each instance. Consequently, exclusively vertical frames 25.2 that are also called first standard frames 25.2 and whose detailed configuration will be explained in greater detail in connection with FIG. 7 are used in the exemplary embodiment shown in FIG. 2.

Also in the case of the exemplary embodiment shown in FIG. 2, two vertical frames 25.2, 25.2 according to the invention, in each instance, are provided per height block 100.5, 100.6. These are disposed in pairs, in each instance, at a horizontal distance from one another, which here is determined by the length of a horizontal longitudinal cross-bar or scaffold cross-bar 28.2 provided with known connecting heads 250 of a modular scaffold system, here of the Layher Allround scaffold system. The length of the scaffold cross-bars 28.2 is greater than the distance 31 of the longitudinal axes 32.2, 32.2 of the two vertical supports 30.3, 30.4 of the vertical frames 25.2 (cf. FIG. 7). The longitudinal cross-bars or scaffold cross-bars 28.2 are disposed parallel to one another and perpendicular to the vertical planes spanned by the two vertical frames 25.2, 25.2, in each instance. In the case of these constructions, a rectangular outline 99 is therefore obtained, as can be seen in FIG. 4.

The height blocks 100.5, 100.6 are formed with two, in each instance, of the similar or identical vertical frames 25.2, 25.2, which are disposed in pairs. The first height block 100.5, which is assigned to the ground, i.e. the vertical supports 30.3, 30.4 of its vertical frames 25.2, 25.2, support(s) itself/themselves on the ground by way of previously known so-called starting pieces 39, whose vertical pipes are equipped with the known perforated disks of a modular scaffold system, here of the Layher Allround scaffold system, again by way of foot spindles 29.

To construct the supporting scaffold 21.2 that is shown in FIG. 2 or the supporting scaffold tower 22.2 that is shown in it, first a closed horizontal base frame, of a manner known for the construction of modular scaffolding, consisting of five scaffold components here, namely two parallel longitudinal cross-bars 28.2, 28.2, two parallel and transverse cross-bars 28.1, 28.1, disposed perpendicular to them, in each instance, and a horizontal diagonal 23.2, is constructed. These scaffold cross-bars or braces again, in known manner, have connecting heads 150 (vertical diagonal 23.2) or connecting heads 250 (scaffold cross-bar 28.1, 28.2), at their two ends, in each instance, by means of which, along with the known pass-through wedges, these scaffold components are fixed in place on four perforated disks 45 of four starting pieces 39, which support themselves on the ground, in each instance, by way of a foot spindle 29. The scaffold cross-bars 28.1 and 28.2 span a horizontal plane in which the horizontal diagonal 23.2 also extends.

Proceeding from this, the further construction of the other exemplary embodiments of a supporting scaffold 21.2 or of a supporting scaffold tower 22.2 shown in FIG. 2 takes place.

For this purpose, the free ends of the vertical supports 30.3, 30.4 of the two vertical frames 25.2, 25.2 are therefore set onto or into the pipes of the starting pieces 39. Subsequently, the two vertical frames 25.2, 25.2 are vertically braced using two horizontally spaced-apart vertical diagonals 39. For this purpose, these vertical diagonals 24.3 are fixed in place, with one of their connecting heads 150, on one of the perforated disks 45 of the vertical frames 25.2, while they are fixed in place, with their other connecting head, on a perforated disk 45 of a starting piece 39, in each instance. For the purpose of further reinforcement, here the two vertical frames 25.2, 25.2 of the first height block 100.5 can be and are connected with one another with two longitudinal cross-bars 28.2. These two longitudinal cross-bars 28.2 are fixed in place, with their connecting heads 250, in each instance, on a perforated disk 45, in each instance, of the two vertical frames 25.2, 25.2 that lie opposite one another.

In the second exemplary embodiment shown in FIG. 2, a second height block 100.6, that has essentially the same construction or is the same, is disposed above the first height block 100.5, and again is constructed from two similar or identical vertical frames 25.2. In the case of this height block 100.6, the connecting heads 150 attached at the lower ends of the two vertical diagonals 24.3 are fixed in place on a perforated disk 45, in each instance, of a vertical frame 25.2, 25.2 assigned to the height block 100.5 that is situated underneath. In the region of the upper end of the upper height block 100.6, again, a horizontal diagonal 23.2 is provided for horizontal reinforcement, whose connecting heads 150 are fixed in place on two of the perforated disks 45 of the two vertical frames 25.2, 25.2, which disks lie opposite one another. In the case of this exemplary embodiment, as well, head spindles 38 are set onto the upper ends of the vertical supports 30.3, 30.4 of the vertical frames 25.2, 25.2, by means of which spindles precision adjustment of the height for accommodating a supporting load to be supported by way of the beams 26 can be adjusted.

As shown in FIG. 5, for further reinforcement, multiple, here two, for example, similar or identical vertical frames 25 according to the invention, here two of the equalization frames 25.1, 25.1, can be coupled with one another, in double manner, or parallel-parallel to one another. The placement or coupling can therefore advantageously take place in such a manner that the vertical planes spanned by the vertical frames 25.1, 25.1 to be coupled are disposed parallel to one another in the coupled state. The coupling can advantageously take place using connecting head devices 96 or double connecting heads or double wedge heads 96. These can be configured with a first connecting head unit 96.1 and a second connecting head unit 96.2 having a similar structure. As connecting head devices 96, in the exemplary embodiment shown in FIG. 5, connecting head devices are shown that have at least two connecting head units, connected with one another, for connecting to the perforated disks 45, as they are disclosed in DE 299 06 742 U1 or the parallel EP 1 045 088 A1. It is understood that in the same or similar manner, within the scope of the invention, vertical frames 25 that are configured in any desired manner, particularly ones that are the same, in each instance, can be coupled with one another, in other words particularly also two or more of the first standard frames 25.2, 25.2 or two or more of the vertical frames that can be seen in FIG. 8 and are referred to as second standard frames 25.3.

Preferred exemplary embodiments of vertical frames 25; 25.1, 25.2, 25.3 according to the invention are shown in FIGS. 6 to 8. Each of these vertical frames 25; 25.1, 25.2, 25.3 is constructed from two parallel vertical supports 32.1, 32.1; 32.2, 32.2; 32.3, 32.3 disposed at a horizontal distance 31 relative to one another and two parallel horizontal arms 35; 35.1, 35.2; 35.3, 35.4; 35.5, 35.6 disposed at a vertical distance 36.1; 36.2; 36.3 relative to one another, which are welded to one another, forming a closed frame 25. In this connection, the two horizontal arms 35.1, 35.2; 35.3, 35.4; 35.5, 35.6, in each instance, or respectively, their longitudinal axes 47.1; 47.2; 47.3 are disposed and welded in place perpendicular to the vertical supports 30.1, 30.2; 30.3, 30.4; 30.5, 30.6 or their longitudinal axes 32.1; 32.2; 32.3. Each horizontal arm 35.1 to 35.6 is therefore welded to two of the horizontally spaced-apart vertical supports 30.1, 30.2; 30.3, 30.4; 30.5, 30.6, in each instance, specifically, in the exemplary embodiment shown, in such a manner, in each instance, that the horizontal arm 35.1 to 35.6, in each instance, extends between the two vertical supports 30.1, 30.2; 30.3, 30.4; 30.5, 30.6, in each instance.

In the exemplary embodiments shown, the closed frames or the vertical frames 25; 25.1, 25.2, 25.3 according to the invention have a quadragonal, here a rectangular outline. It is understood, however, that the vertical frames according to the invention can also have or span other outlines, particularly polygonal ones, for example square outlines.

Each vertical frame 25; 25.1, 25.2 according to the invention furthermore also has at least one diagonal rod 40; 40.1, 40.2, 40.3 that diagonally reinforces the closed frame, in each instance. In the exemplary embodiments shown in FIG. 6 to 8, only a single diagonal rod 40.1, 40.2, 40.3 is provided, in each instance. However, it is understood that more than one diagonal rod, for example in a crossed arrangement or another diagonal arrangement, can also be provided for reinforcement of the vertical frames according to the invention.

In the exemplary embodiments shown, the diagonal rod 40.1, 40.2, 40.3, in each instance, extends both between the two vertical supports 30.1, 30.2; 30.3, 30.4; 30.5, 30.6, in each instance, and the two horizontal arms 35.1, 35.2; 35.3, 35.4; 35.5, 35.6. It is understood, however, that such or other diagonal rods do not necessarily have to be disposed in the plane spanned by the vertical supports 30 and/or in the plane spanned by the horizontal arms 35. In the exemplary embodiments shown, the diagonal rod 40.1, 40.2, 40.3, in each instance, in the region of its two ends, is welded onto one of the vertical supports 30.1, 30.2; 30.3, 30.4; 30.5, 30.6, in each instance, of the vertical frame 25.1, 25.2, 25.3, in each instance. The ends of the diagonal rod 40.1, 40.2, 40.3, in each instance, are configured as flat connectors 42. For this purpose, the diagonal rods 40; 40.1, 40.2, 40.3, which are configured as round pipes here, are compressed or squeezed together at their ends, in each instance.

In the exemplary embodiments shown, the diagonal rods 40; 40.1, 40.2, 40.3, the vertical supports 30; 30.1, 30.2; 30.3, 30.4; 30.5, 30.6 and the horizontal braces 47; 47.1, 47.2, 47.3 of the horizontal arms 35; 35.1 to 35.6 are configured, in each instance, as round pipes made of steel, preferably zinc-plated steel. Preferably, scaffold pipes that are available as standard items are used for this purpose.

In the exemplary embodiments shown, the vertical supports 30; 30.1, 30.2; 30.3, 30.4; 30.5, 30.6, preferably also the horizontal braces 47; 47.1, 47.2, 47.3 of the horizontal arms 35; 35.1, 35.2; 35.3, 35.4; 35.5, 35.6 have an outside diameter 94.1 that amounts to 48.3 mm here. This is a standardized dimension, particularly in the case of modular scaffolding such as the Layher Allround scaffold system. Providing scaffold pipes that have an outside diameter of 48.3 mm has the advantage that if necessary, standard scaffold couplings can be connected to the vertical frames 25.

The wall thickness 86 of both the vertical supports 30 and also of the horizontal braces 47 of the horizontal arms 45 is the same size here, in each instance, and in the exemplary embodiment, amounts to 4.0 mm, in each instance. In contrast to this, the diagonal braces 40; 40.1, 40.2, 40.3 of the vertical frames 25; 25.1, 25.2, 25.3 according to the invention have an outside diameter 95 that amounts to 33.7 mm here. The wall thickness of the diagonal braces 40; 40.1, 40.2, 40.3 amounts to 3.2 mm here.

The vertical frames 25; 25.1, 25.2, 25.3 according to the invention are particularly characterized in that at least one perforated disk 45; 45.1, 45.2; 45.3, 45.4 provided with multiple perforations 46; 46.1, 46.2, for connecting holding devices, particularly for suspending supporting and/or connecting elements, preferably scaffold elements that run horizontally and/or diagonally, for example scaffold cross-bars and/or scaffold diagonals, as they are shown, for example, in FIGS. 1 to 5, in the form of horizontal scaffold cross-bars 28.1, 28.2 and/or diagonals 23.1, 23.2, 24.1, 24.2, 24.3, particularly of a modular scaffold, here of the Layher Allround scaffold system, are permanently attached, here by means of welding, in the region of the upper end 33.1, 33.2, in each instance, and/or in the region of the lower end 34.1, 34.2, in each instance, of the vertical supports 30; 30.1, 30.2; 30.3, 30.4; 30.5, 30.6, at least in each instance.

In this connection, each perforated disk 45 of these perforated disks 45 is disposed concentric to the vertical support 30, in each instance, and surrounds the vertical support 30 over its full circumference here, in the manner of a flange. At least one horizontal arm 35 of the horizontal arms comprises a horizontal brace 47, here a straight brace, which is configured or provided, at its ends that face away from one another, with a connecting head 50, in each instance, which is formed in one part or in one piece or in multiple pieces with the horizontal brace 47. In the exemplary embodiments shown, the connecting heads, in each instance, of the horizontal arms 35 of the vertical frames 25 are formed in one part or in one piece, in each instance, with the horizontal brace 47, in each instance.

The connecting head 50, in each instance, of the horizontal brace 47, in each instance, is preferably delimited with side wall parts 51, 52, which have vertical outer surfaces 53, 54 that run, in wedge-like manner, toward a center, particularly toward the post and disk center 49, which surfaces enclose a wedge angle 55 that particularly amounts to 40 degrees to 50 degrees, preferably about 45 degrees, here about 44 degrees. The connecting head 50, in each instance, has an upper head part 56 and a lower head part 57, which here are connected with one another in one piece and configured in one piece. A slit 58 that is open toward the related vertical support 30; 30.1, 30.2; 30.3, 30.4; 30.5, 30.6 is provided between the upper head part 56 and the lower head part of the connecting head 50, in each instance, whereby the connecting head 50, in each instance, is set onto the perforated disk 45, with its slit 58, with the disk at least partly projecting into the slit, and is welded onto the vertical support 30, in each instance, here also onto the perforated disk 45, in this set-on position.

In this manner, a particularly bending-resistant and twisting-resistant, stable vertical frame 25 is created, which can be used in many advantageous ways to construct spatial supporting systems such as scaffolding, particularly to construct frame supports 20, supporting scaffolds 21 and/or supporting scaffold towers 22, which is/are compatible with a suitable modular scaffold, in other words can be combined with it, which also is constructed or can be constructed with corresponding or suitable posts having perforated disks. In particular, at least two of the preferably similar or identical vertical frames 25 according to the invention can be connected by means of scaffold components that can also be used in the suitable modular scaffold, in other words particularly scaffold cross-bars, for example longitudinal and/or transverse cross-bars and/or diagonals, as they can be used, particularly in the form of vertical and/or horizontal diagonals of such a modular scaffold.

The arrangement and configuration of the connecting heads 50 formed, in each instance, in one part or in one piece and of the same material, with a preferably straight rod, here with a horizontal brace 47, is particularly evident from FIGS. 9 to 13. The connecting head 50, there designated in general with the reference symbol 50, has an upper head part 56 and a lower head part 57, which are connected with one another in one piece or configured in one part. The upper head part 56 has upper side wall parts 51.1 and 51.2, and the lower head part 57 has lower side wall parts 52.1 and 52.2.

The upper vertical outer surfaces 53.1 and 53.2 as well as the lower vertical outer surfaces 54.1 and 54.2 of the side wall part 51.1, 51.2; 52.1, 52.2 enclose a wedge angle 55 that amounts to about 44 degrees here. Between the upper head part 56 and the lower head part 57 of each connecting head 50 of the horizontal arms 35 of the vertical frames 25, a horizontal slit 58 is provided, which is open toward the related vertical brace 30 and toward the vertical outer surfaces 53.1, 53.2; 54.1, 54.2.

The slit 58 is delimited by horizontal upper and lower slit surfaces 66.1, 66.2, which are disposed parallel to one another and parallel to the longitudinal axis 37, in each instance, of the horizontal arm 35, in each instance, or its horizontal brace 47, in each instance. The connecting heads 50 are welded, in each instance, onto one of the vertical supports 30 of the vertical frame 25, in such a manner that the horizontal plane 71 that intersects the slit 58 at the height of half the slit width 70 lies about in center plane 72 that intersects the perforated disk 45 at the height of its center.

Each connecting head 50 is configured symmetrical to the horizontal plane 71 and also symmetrical to a vertical plane 82 that is disposed perpendicular to it and also contains the longitudinal axis 47 of the horizontal arm 35 or its horizontal brace 47.

The upper head part 56 has upper vertical contact surfaces 80.1.1, 80.1.2, and the lower head part 57 has lower vertical contact surfaces 80.2.1, 80.2.2, with which the connecting head 50 lies against the outer surface of the vertical support 30. The upper end 81.1 of the upper head part 56 and the lower end 81.2 of the lower head part 57 project beyond the horizontal brace 47 of the horizontal arm 35, or its outside diameter, respectively, in the region of the contact surfaces 80.1.1, 80.1.2; 80.2.1, 80.2.2, in each instance, viewed in a direction perpendicular to the longitudinal axis 37 of the transverse arm 35 or its horizontal brace 47.

The height 76.1 of the upper head part 56 and the height 76.2 of the lower head part 57 decreases toward the rear, in other words in the direction toward the horizontal brace 47, here continuously and without any bends, to the outside diameter 94.2 of the horizontal brace 47 of the horizontal arm 35. The upper outer surface 77.1 and the lower outer surface 77.2 of the connecting head 50 are therefore inclined, in each instance, toward the horizontal brace 47 of the horizontal arm 35, specifically, here, at an angle 78.1, 78.2 to an imaginary line that runs parallel to the longitudinal axis 37 of the transverse arm 35 or its horizontal brace 47, which angle amounts to about 45 degrees here.

The contact wall parts 80.1.1, 80.1.2; 80.2.1, 80.2.2 of the connecting head 50 have a partly cylindrical shape and are configured, viewed in a cross-section perpendicular to the longitudinal axis 32 of the related vertical support 30, with a radius that corresponds to the outer radius of the vertical support 30, which preferably amounts to about 24.15 mm here.

The distances 76.1 of the upper end 81.1 of the upper contact surfaces 80.1.1, 80.1.2 and the distances 76.2 of the lower end 81.2 of the lower contact surfaces 80.2.1, 80.2.2 from the horizontal plane 71 that intersects the slit 58 at the height of half the slit width 70 are of the same size.

The slit of the connecting head 50 has a slit width 70 that amounts to about 10 mm, whereby the slit width 70 is only slightly greater than the thickness of the perforated disk 45, in each instance, which amounts to about 9 mm here.

Each connecting head 50 is welded, as is particularly shown in FIGS. 11 and 12, not only to one of the vertical supports 30 of the vertical frame 25, but rather also to one of the perforated disks 45. In this connection, it is provided, according to the invention, that the connecting head 50 is welded to the related vertical support 30 and to the related perforated disk 45, if necessary with the exception of at least one liquid run-off opening 69.1, 69.2, by way of a continuous weld seam 61.1, 62.1, 61.2, 62.2, 63.1, 63.2, 65.1, 68.1, 68.2, in the region of all its outer surfaces that follow its surfaces that lie directly opposite the related vertical support 30 and the related perforated disk 45. In this way, an optimal connection between the horizontal arm 35, respectively between its two connecting heads 50 that are configured or formed on in one part or in one piece, and using the same material, with the vertical supports 30 assigned to them, and also to the perforated disks 45, is achieved, so that this connection is configured to be bending-resisting and twisting-resistant, in particular manner. Consequently, the upper head part 56 and also the lower head part 57 of the connecting head 50 are therefore welded to the related vertical support 30, in regions of its vertical outer surfaces 53.1, 53.2; 54.1, 54.2 of its side wall parts 51.1, 51.2; 52.1, 52.2, and also in regions of its horizontal outer surfaces that follow its vertical contact wall parts 80.1.1, 80.1.1; 80.2.1, 80.2.2 toward the top and the bottom, toward the outside, in each instance, if necessary with the exception of a liquid run-off opening 69.1, 69.2 that might be provided, by way of a continuous weld seam 61.1, 62.1 as well as 61.2, 62.2, in each instance.

Furthermore, the upper head part 56 and also the lower head part 57 of the connecting head 50 are welded together in regions of its vertical outer surfaces 53.1, 53.2; 54.1, 54.2 of its side wall parts 51.1, 51.2; 52.1, 52.2, which follow the horizontal slit surfaces 66.1, 66.2 of the slit 58 toward the outside, over the entire width of the part 89 of the related perforated disk 45 that projects into the slit 58 of the connecting head 50, in each instance, by way of a continuous weld seam 63.1 and 63.2.

Furthermore, the upper head part 56 and the lower head part 57 of the connecting head 50 are welded to the face surfaces of the related perforated disk 45 that are situated in the region of the slit 58 and face outward, in regions of its vertical outer surfaces 53.1, 53.2; 54.1, 54.2 of the side wall parts 51.1, 51.2; 52.1, 52.2, which follow the vertical slit surfaces 67 of the slit 58 toward the outside, by way of a continuous weld seam 65.1, in each instance, whereby at least one liquid run-off opening 69.1, 69.2 can be excepted from the weld (see FIGS. 12 and 13).

As is evident from the figures, the connecting head 50, in each instance, of the horizontal arms 35 is configured in such a manner, and disposed on the related perforated disk 45, with its slit 58 engaging over it, at least in part, in such a manner that with the exception of a single perforation 46.1, which is the smaller perforation 46.1 of the perforations 46; 46.1, 46.2 of the related perforated disk 45, all the other perforations 46.1 and 46.2 of this perforated disk 45 can be used for connecting holding devices, particularly for suspending usual connecting heads, particularly those of a modular scaffold, particularly of the Layher Allround scaffold system, which are provided, in each instance, with an undetachable wedge 64, preferably of scaffold elements that run horizontally and/or diagonally.

The connecting heads 50 that are formed onto the brace 47, in one piece with the brace 47; or in one piece and from the same material, can be produced by means of forming, particularly by means of compressing or squeezing together the ends, in each instance, of the horizontal brace 47, which is configured using a round pipe here.

As is particularly evident from FIG. 10, the length 124 of the vertical outer surfaces 53.1, 53.2; 54.1, 54.2, which narrow in wedge shape, of the side wall part 51.1, 51.2; 52.1, 52.2 of the connecting heads, amounts to about 35 mm viewed in a projection direction perpendicular to the longitudinal axis 47 of the horizontal arm 35 or its horizontal brace 47, and also perpendicular to the longitudinal axis 32 of the vertical supports 30.

It is practical if the perforated disks 45 of the vertical frames 25 are configured in the same manner as the perforated disks of a modular scaffold system, here of the Layher Allround scaffold system. Accordingly, the perforated disks 45 are disposed concentric to the vertical support 30, in each instance, and surround the vertical support 30, in each instance, in the manner of a flange, at least in part, preferably over the full circumference, and specifically preferably without interruption. The perforated disks 45 have at least three, here four small perforations 46.1 and four large perforations 46.2, which are disposed to alternate at equal circumference angles 88 of here 45 degrees relative to one another. In this way, connecting heads 150, 250 of horizontal and/or diagonal connecting or scaffold elements, particularly of longitudinal and/or horizontal cross-bars as well as diagonal rods, preferably of a modular scaffold, particularly of the Layher Allround scaffold system, can be suspended or fixed in place at these perforations 46.1, 46.2, preferably in releasable manner.

With regard to such standard-production connecting heads of a modular scaffold system, known from the state of the art, along with standard-production perforated disks and standard-production connecting elements, reference can be made, for example, to DE-PS 24 49 124, DE 37 02 057 A or the parallel EP 0 276 487 B1, DE 39 34 857 A1 or the parallel EP 0 423 516 B2, DE 198 06 094 A1 or the parallel EP 0 936 327 B1 and the parallel EP 1 452 667 B1 of the applicant.

Alternative perforated disk configurations are evident, for example, from DE 39 09 809 A1 or the parallel EP 0 389 933 B1 and DE 200 12 589 U1 as well as the parallel WO 02/06610 A1 and the parallel EP 1 301 673 A1 of the applicant. The content of these patents is incorporated at this point, in its entirety, for the sake of simplicity.

The exemplary embodiments of vertical frames 25; 25.1, 25.2; 25.3 according to the invention shown in FIGS. 6, 7, and 8, in an enlarged top view, differ in a number of characteristics, which are listed as follows:

The vertical frame 25.1 shown in FIG. 6 and also called an equalization frame 25.1 has two straight vertical supports 30.1 and 30.2, having the same length 92.1, in each instance. The length 92.1 is smaller than the horizontal distance 31 between the two vertical supports 30.1, 30.2 or between the longitudinal axes 32.1, 32.1 of these two vertical supports 30.1 and 30.2. The length 92.1 of each of these vertical supports 30.1, 30.2 amounts to precisely 70.9 cm in the exemplary embodiment shown.

The horizontal distance 31 amounts to precisely 1,088 mm, in each instance, also in the case of the two other vertical frames 25.2 according to FIGS. 7 and 25.3 according to FIG. 8, which corresponds to a system width of a matching modular scaffold system, here of the Layher Allround scaffold system.

The vertical supports 30.1 and 30.2 of the vertical frames 25.1, also called equalization frames, have precisely two perforated disks 45.1 and 45.3 or 45.2 and 45.4, in each instance. These four perforated disks 45.1 to 45.4 are fixed in place, in each instance, in this exemplary embodiment, spaced at equal distances 93.1, 93.2 of here 100 mm, in each instance, from the ends 33.1, 33.2; 34.1, 34.2 of the vertical supports 30.1, 30.2, here by means of welding.

By means of the upper and lower distances 93.1 and 93.2, which are selected to be the same here, the vertical frames 25.1 also called equalization frames are therefore configured "symmetrically" with regard to a horizontal plane of symmetry that runs parallel to the longitudinal axes 47.1 of their horizontal arms 35.1, 35.2 and centered, which is disposed perpendicular to the longitudinal axes 32.1, 32.2 of the vertical supports 30.1 and 30.2. In this manner, it is not important, when assembling these vertical frames 25.1, that they are assembled with the correct sides together or set on with the correct sides together.

The distance 41 of the two perforated disks 45, in each instance, per vertical support 30, corresponds to the vertical distance 36.1 of the horizontal arms 35.1 and 35.2 or their longitudinal axes 47.1, 47.1, which here therefore amounts to precisely 500 mm.

The distance 41 between the two perforated disks 45.1 and 45.3, in each instance, of the first vertical support 30.1, and between the two perforated disks 45.2 and 45.4 of the second vertical support 32.1, is the same, in each instance, and amounts to 500 mm here.

The diagonal brace 40.1 welded in between the two vertical supports 30.1 and 30.2 of the vertical frame 25.1 has a length 84.1 that amounts to 1,110.5 mm here. The longitudinal axis 73.1 of the straight diagonal rod 40.1 intersects the longitudinal axis 32.1 of the vertical support 30.1 shown on the left in FIG. 6 at a distance 85.1 from the lower perforated disk 45.3 attached to this vertical support 30.1, or from the longitudinal axis 37.2 of the horizontal arm 35.2. This distance 85.1 amounts to 78.5 mm here. At the other end, the longitudinal axis 73.1 of the diagonal brace 40.1 intersects the longitudinal axis 32.1 of the second vertical support 30.2, which is shown on the right in FIG. 6, at a distance 84.1 from the upper perforated disk 85.2 or from the longitudinal axis 37.1 of the horizontal arm 35.1. This distance 84.1 also amounts to precisely 78.5 mm in the exemplary embodiment. The diagonal brace 40.1, respectively its longitudinal axis 73.1, encloses an angle 74.1, in each instance, with the horizontal brace 47.1 of the horizontal arms 35.1, 35.2, in each instance, that amounts to 17.5 degrees here.

The vertical supports 30.1 and 30.2 have a double hole 91 both at their upper ends 33.1, 33.2 and at their lower ends 34.1, 34.2, which extends parallel to the longitudinal axes 37.1, 37.2 of the horizontal arms 35.1, 35.2, in each instance. Each double hole 91 has a distance from the free end, in each instance, of the vertical support 30.1, 30.2, in each instance, that amounts to about 35 mm here. Each double hole 91 has an inside diameter that amounts to about 13 mm here.

The vertical frame 25.2 shown in FIG. 7 and also called a first standard frame has precisely two vertical braces 30.3 and 30.4, having the same length 92.2, in each instance, which length is greater than the horizontal distance 31 of the longitudinal axes 32.2 of the vertical supports 30.3 and 30.4.

The length 92.2 of the vertical supports 30.3 and 30.4 amounts to precisely 1,500 mm here. Also in contrast to the vertical frame 95.1 shown in FIG. 6, the vertical frame 95.2 in FIG. 7 has only a single perforated disk 45.1, in each instance, per vertical support 30.3 or 30.4. In this connection, the perforated disk 45.1, 45.2, in each instance, is disposed in the region of the upper end 33.1, 33.2, in each instance, of the vertical support 30.3 and 30.4, in each instance, specifically at a distance 93.1, that amounts to 100 mm here. Therefore, while in the case of the vertical frame 25.2 shown in FIG. 6, both horizontal arms 35.1 and 35.2 are provided with connecting heads 50.1, 50.2, which are set onto the related perforated disk 45.1, 45.2, 45.3, 45.4 with their slits 58, in each instance, and welded to the vertical support 30.1, 30.2, in each instance, preferably also to the perforated disk 45.1, 45.2, 45.3, 45.4, in each instance, in this set-on position, the vertical frame 25.2 shown in FIG. 7 and also called a first standard frame has only a single horizontal arm 35.3, specifically here the upper horizontal arm 35.3, which is set onto the perforated disk 45.1, 45.2, in each instance, by way of two connecting heads 50.1, 50.2, with its slit 58, in each instance, and welded to the vertical support 30.3, 30.4, in each instance, preferably also to the perforated disk 45.1, 45.2, in each instance, in this set-on position.

In contrast to this, in the case of the vertical frame 25.2, the horizontal arm 35.4 that is fixed in place in the region of the lower ends, in each instance, specifically at a distance 93.2 of here 120.5 mm, is directly welded to the vertical support 30.3 and 30.4, in each instance, in other words without any perforated disks that lie in between. The lower horizontal arm 35.4 accordingly also does not have any corresponding connecting heads 50. It is practical if the ends of the horizontal arm 35.4 are hollowed out in accordance with the outer radius of the vertical supports 30.3 and 30.4, with a corresponding radius, and welded to the vertical support 30.3 and 30.4, in each instance, in the region of its two hollowed-out ends, with a preferably continuous weld seam, i.e. one over the full circumference.

The diagonal brace 40.2 of the vertical frames 25.2 has a length 84.2 that amounts to precisely 1,567 mm here. The diagonal brace 40.2 forms an angle with the vertical brace 30.4 shown on the right in FIG. 7, i.e. the longitudinal axis 73.2 of the diagonal brace 40.2 encloses an angle with the longitudinal axis 32.2 of this vertical brace 30.4, which angle amounts to 42.6 degrees here. The longitudinal axis 73.2 of the diagonal brace 40.2 intersects the longitudinal axis 32.2 of the vertical support 30.3 shown on the left in FIG. 7 at a distance 85.2 from the longitudinal axis 37.4 of the lower horizontal arm 35.4 that amounts to 38.9 mm here. At the other end, the longitudinal axis 73.2 of the diagonal brace 40.2 intersects the longitudinal axis 32.2 of the vertical support 30.4 shown on the right in FIG. 7 at a distance 84.2 from the longitudinal axis 37.3 of the upper horizontal arm 35.3 that amounts to 55 mm here.

The distance of the first perforated disk 45.1 from the longitudinal axis 37.4 of the lower horizontal arm 35.4 and the distance of the perforated disk 45.2 of the second vertical support 30.4 from the longitudinal axis 37.4 of the lower horizontal arm 35.4 is the same, and amounts to 1,275 mm here. The two perforated disks 45.1 and 45.2 have a distance 93.1 from the upper end 33.1, 33.2 of the vertical support 30.3, 30.4, in each instance, that amounts to 100 mm here. The horizontal arm 35.4 or its longitudinal axis 37.4 has a distance 93.2 from the lower end 34.1, 34.2, in each instance, of the vertical supports 30.3, 30.4 that amounts to 120.5 mm here.

In the region of their upper ends 33.1, 33.2, the vertical supports 30.3, 30.4 are provided, in each instance, with a double hole 91, whose longitudinal axis is disposed, in each instance, in the vertical plane spanned by the longitudinal axes 37.3 of the horizontal arm 35.3 and the longitudinal axes 32.2 of the vertical supports 30.3 and 30.4. The double holes 91 have a distance from the upper ends 33.1, 33.2 that amounts to 35 mm here.

In similar manner, in the region of the lower ends 34.1, 34.2 of the vertical supports 30.3 and 30.4, double holes 91 are provided, whose longitudinal axes run parallel to the longitudinal axes of the double holes 91 provided at the upper ends 33.1 and 33.2, specifically in a common vertical plane. These lower double holes 91 also have a distance from the lower ends 34.1, 34.2, in each instance, that amounts to 35 mm here.

In addition, in the region of the lower end 34.1, 34.2, in each instance, of the vertical supports 30.3, 30.4, another double hole 91, in each instance, is also provided, but this is disposed offset about the longitudinal axes 32.2 of the vertical supports 30.3 and 30.4, in contrast, by an angle of 90 degrees. These additional double holes 91 have a distance 122 from the double holes 91 disposed closer to the lower ends 34.1, 34.2, which distance amounts to 40 mm here.

According to another preferred exemplary embodiment of a vertical frame according to the invention, which is not shown in the figures and which can preferably be used as an equalization frame, this can be configured corresponding to the vertical frame 25.2 shown in FIG. 7, but in contrast to this has a height of only 50 cm. In other words, the vertical supports in this further exemplary embodiment of a vertical frame have a length, in each instance, of only 50 cm. In this manner, another vertical frame according to the invention can be made available, but preferably, this frame can be used as an equalization frame. The height or length of its vertical supports preferably corresponds to the usual grid dimensions of a modular scaffold, particularly of the Layher Allround scaffold system.

In contrast to this, the vertical frame 25.2 shown in FIG. 7, also called a standard frame, has a height, respectively a length 92.2 of its vertical supports 30.3, 30.4 that corresponds, at 1,500 mm, to three times the grid dimension of the Layher Allround scaffold system.

According to the further exemplary embodiment of a further vertical frame according to the invention, which can preferably be used as an equalization frame and is not shown in the figures, this frame then has, in contrast to the equalization frame 25.1 shown in FIG. 6, only one perforated disk, in each instance, per vertical support, in other words similar to the vertical frame 25.2 shown in FIG. 7.

In FIG. 8, a further exemplary embodiment of a vertical frame 25.3 according to the invention is shown. This exemplary embodiment again is a "symmetrical" vertical frame 25.3. This frame, similar to the vertical frame 25.1 shown in FIG. 6, is equipped with precisely two perforated disks 45.1, 45.3; 45.2, 45.4, in each instance, per vertical support 30.5, 30.6. In contrast to this vertical frame 25.1, the vertical supports 30.5 and 30.6 of the vertical frame 25.3 have a height or a length 92.3 that amounts to 1,759 mm here. In accordance with the said "symmetry," each of the here four perforated disks 45.1, 45.2, 45.3 45.4 has a distance 93.3, 93.4 from the related end 33.1, 34.1; 33.2, 34.2 of the related vertical support 30.5, 30.6 that is the same, in each instance, but in contrast to the vertical frame 25.1 shown in FIG. 6, is now greater and amounts to 125 mm here.

Furthermore, the distance 36.3 of the two perforated disks 45.1, 45.3; 45.2, 45.4 fixed in place on one of the vertical supports 30.5, 30.6, in each instance, or the distance 36.3 between the longitudinal axis 37.5 of the upper horizontal arm 35.5 or its horizontal brace 47.3 and the longitudinal axis 37.6 of the lower horizontal arm 35.6 or its horizontal brace 47.3 amounts to 1,500 mm here.

The diagonal brace 40.3 of the vertical frame 35.3 has a length 48.3 that amounts to 1,735.4 mm here. This diagonal brace 40.3, too, is welded in between the two vertical supports 30.5 and 30.6. The diagonal brace 40.3 or its longitudinal axis 73.3 encloses an angle 74.3, with each of the horizontal arms 35.5, 35.6 or their longitudinal axes 47.3, which angle amounts to 52.2 degrees here.

The vertical supports 30.5 and 30.6 have a double hole 91, in each instance, in the region of their free ends 33.1, 34.1; 33.2, 34.2. However, the longitudinal axis of this hole, in each instance, in contrast to the frame 25.1 shown in FIG. 6, now stands perpendicular to the vertical plane spanned by the longitudinal axes 37.5, 37.6 of the horizontal arms 35.5, 35.6 and the longitudinal axes 32.3 of the vertical supports 30.5 and 30.6. These double holes 91, too, have an inside diameter, in each instance, that amounts to 13 mm here. These double holes 91 have a distance from the free end 33.1, 34.1; 33.2, 34.1, in each instance, of the vertical support 30.5, 30.6, in each instance, that amounts to 35 mm here.

By means of the selection of the distances 36.3 of here 1,500 mm between the two perforated disks 45.1, 45.3; 45.2, 45.4, in each instance, of the vertical brace 30.5, 30.6, in each instance, in connection with the distances of the perforated disk 45.1, 45.2, 45.3, 45.4, in each instance, from the free ends 33.1, 34.1; 33.2, 34.2, in each instance, i.e. the distances 93.3 and 93.4, which are the same here, and amount to 125 mm here, a vertical frame 25.3 also called a second standard frame is achieved, which can be used in combination with standardized vertical diagonals that are available for a quadruple grid dimension of a height of 2 m, in the case of a modular scaffold, particularly the Layher Allround scaffold system. In this way, additional cost advantages can be achieved for a combination with these vertical frames 25.3.

To construct frame supports 20 according to the invention or supporting scaffolds 21 according to the invention or supporting scaffold towers 22, according to the invention, at least two of the vertical frames 25 according to the invention are disposed one on top of the other and fixed in place relative to one another, to prevent displacement. In this connection, one possibility is fixing them in place by setting them onto one another. For this purpose, it can be advantageous to provide a pipe connector, in each instance, as a connection means, as it is shown, for example, in FIG. 14.

It is practical if such a pipe connector 105 is inserted into the lower ends, in each instance, of the vertical supports of the vertical frames 25.2 or 25.3, also called standard frames, and fixed in place there using screws, particularly hex screws 101, if necessary with matching securing nuts. For this purpose, the pipe connectors 105 have an outside diameter 106 that is slightly smaller than the inside diameter of the vertical supports 30. The outside diameter 106 of the pipe connector 105 amounts to 38 mm here. The pipe connector 105 has a wall thickness 107 that amounts to 3.6 mm here. The length 108 of the pipe connector amounts to 260 mm here.

The pipe connector 105 has an attachment insertion end 114 with which the pipe connector 105 is inserted into one of the vertical supports 30. The pipe connector 105 can be inserted in this manner, using screws 101, that are inserted through a double hole 112 provided at a distance 120 of here 20 mm from the attachment insertion end 140, which hole has a diameter 113 of here 13 mm, and also through a double hole 91 provided in the region of the ends of the related vertical support 30.

At its other end, i.e. at the insertion end 115, the pipe connector 105 has a chamfer 116 that preferably has a width 121 of here 5 mm. This chamfer 116 facilitates insertion into vertical supports 30 of other vertical frames 25. In the center between its ends and accordingly at a distance 117 of here 130 mm, the pipe connector 105 has not only a first double hole 109 but also a second double hole 110. The longitudinal axes of these two double holes 109 and 110 are disposed at an angle of 90 degrees relative to one another, viewed relative to a horizontal plane disposed perpendicular to the longitudinal axis of the pipe connector 105. These double holes 109 and 110, too, have an inside diameter 113 that amounts to 13 mm here. The provision of such a crossed quadruple hole consisting of two double holes 109 and 110 that intersect at an angle of 90 degrees allows not only assembly of vertical frames 25 according to the invention in consecutive height blocks, offset by 90 degrees relative to one another, but also assembly of two vertical frames 25 according to the invention, one on top of the other, i.e. with aligned vertical planes, in each instance, spanned by these vertical frames 25. For this purpose, a screw 101 is inserted either through the one double hole 109 or through the other double hole 110 as well as a double hole 91 of the vertical frame 95 to be connected with it, depending on the assembly situation, and secured, preferably with a securing nut.

It is understood that the invention is not restricted, with regard to the vertical frames 25 according to the invention shown in the figures, and with regard to the frame supports, supporting scaffolds and/or supporting scaffold towers that can be constructed from them, to the exemplary embodiments shown in the figures, but rather can be configured, dimensioned and/or structured in any other way desired, within the scope of the idea of the invention.

REFERENCE SYMBOL LIST

20 frame support, stacking tower support
20.1 frame support, stacking tower support
20.2 frame support, stacking tower support
21 supporting scaffold, falsework
21.1 supporting scaffold, falsework
21.2 supporting scaffold, falsework
22 supporting scaffold tower, falsework tower, stacking tower
22.1 supporting scaffold tower, falsework tower, stacking tower
22.2 supporting scaffold tower, falsework tower, stacking tower
23.1 horizontal diagonal
23.2 horizontal diagonal
24.1 vertical diagonal
24.2 vertical diagonal
24.3 vertical diagonal
25 vertical frame
25.1 vertical frame, equalization frame
25.2 vertical frame, first standard frame
25.3 vertical frame, second standard frame
26 I-beam
27.1 horizontal section plane 3-3
27.2 horizontal section plane 4-4
28.1 scaffold cross-bar, transverse cross-bar
28.2 scaffold cross-bar, longitudinal cross-bar
29 foot spindle
30 vertical support
30.1 first vertical support
30.2 second vertical support
30.3 first vertical support
30.4 second vertical support
30.5 first vertical support
30.6 second vertical support
31 horizontal distance
32 longitudinal axis of 30
32.1 longitudinal axis of 30.1, 30.2
32.2 longitudinal axis of 30.3, 30.4
32.3 longitudinal axis of 30.5, 30.6
33 upper end of 30
33.1 upper end of 30.1, 30.3, 30.5
33.2 upper end of 30.2, 30.4, 30.6
34 lower end of 30
34.1 lower end of 30.1, 30.3, 30.5
34.2 lower end of 30.2, 30.4, 30.6
35 horizontal arm
35.1 first horizontal arm
35.2 second horizontal arm
35.3 first horizontal arm
35.4 second horizontal arm
35.5 first horizontal arm
35.6 second horizontal arm
36 vertical distance
36.1 vertical distance
36.2 vertical distance
36.3 vertical distance
37 longitudinal axis of 35
37.1 longitudinal axis of 35.1
37.2 longitudinal axis of 35.2
37.3 longitudinal axis of 35.3
37.4 longitudinal axis of 35.4
37.5 longitudinal axis of 35.5
37.6 longitudinal axis of 35.6
38 head spindle
38.1 U-profile
39 starting piece
40 diagonal rod
40.1 diagonal rod
40.2 diagonal rod
40.3 diagonal rod
41 vertical distance
42 flat connector
43 scaffold bottom
44 suspension hook
45 perforated disk
45.1 first perforated disk
45.2 second perforated disk
45.3 third perforated disk
45.4 fourth perforated disk
46 perforation
46.1 small perforation
46.2 large perforation
47 horizontal brace
47.1 horizontal brace
47.2 horizontal brace
47.3 horizontal brace
49 post and disk center
50 connecting head
50.1 first connecting head
50.2 second connecting head
51.1 upper side wall part
51.2 upper side wall part
52.1 lower side wall part
52.2 lower side wall part
53.1 upper vertical outer surface
53.2 upper vertical outer surface
54.1 lower vertical outer surface
54.2 lower vertical outer surface
55 wedge angle

56 upper head part
57 lower head part
58 slit
59.1 upper contact wall part
59.2 lower contact wall part
60.1 upper horizontal outer surface
60.2 lower horizontal outer surface
61.1 upper vertical weld seam
61.2 lower vertical weld seam
62.1 upper horizontal weld seam
62.2 lower horizontal weld seam
62.1 upper horizontal weld seam
63.2 lower horizontal weld seam
64 wedge
65.1 vertical weld seam
65.2 vertical weld seam
66.1 upper horizontal slit surface
66.2 lower horizontal slit surface
67 vertical slit surface
68.1 upper weld seam
68.2 lower weld seam
69.1 liquid run-off opening
69.2 liquid run-off opening
70 slit width
71 horizontal plane
72 center plane of 30
73 longitudinal axis of 40
73.1 longitudinal axis of 40.1
73.2 longitudinal axis of 40.2
73.3 longitudinal axis of 40.3
74 angle
74.1 angle
74.2 angle
74.3 angle
75 height
76.1 height of 56
76.2 height of 57
77.1 upper outer surface
77.2 lower outer surface
77.2.1 lower outer surface
77.2.2 lower outer surface
78.1 angle
78.2 angle
78.2.1 angle
78.2.2 angle
79.1.1 radius
79.1.2 radius
79.2.1 radius
79.2.2 radius
80.1 upper contact surface
80.1.1 upper contact surface
80.1.2 upper contact surface
80.2 lower contact surface
80.2.1 lower contact surface
80.2.1 lower contact surface
81.1 upper end
81.2 lower end
82 vertical plane
83.1 upper wall part
83.2 lower wall part
84 length of 40
84.1 length of 40.1
84.2 length of 40.2
84.3 length of 40.3
85 distance
85.1 distance
85.2 distance
85.3 distance
86 wall thickness of 30, 47
87 wall thickness of 40
88 circumference angle
89 perforated disk part
90 connection node
91 double hole
92.1 length of 30.1, 30.2
92.2 length of 30.3, 30.4
92.3 length of 30.5, 30.6
93.1 distance
93.2 distance
93.3 distance
93.4 distance
94.1 outside diameter of 30
94.2 outside diameter of 47
95 outside diameter of 40
96 connecting head device, double connecting head, double wedge head
96.1 first connecting head unit
96.2 second connecting head unit
97 distance
98 square outline
99 rectangular outline
100 height block
100.1 (equalization) height block
100.2 (standard) height block
100.3 (standard) height block
100.4 (equalization) height block
100.5 (standard) height block
100.6 (standard) height block
101 screw, hex screw
105 pipe connector
106 outside diameter of 105
107 wall thickness of 105
108 length of 105
109 double hole
110 double hole
111 double hole
112 double hole
113 diameter of 91, 109, 110, 111, 112
114 (attachment) insertion end of 105
115 insertion end of 105
116 chamfer
117 distance
118 distance
119 distance
120 distance
121 width of 116
122 distance
124 length
125 distance
150 connecting head
151.1 upper side wall part
151.2 upper side wall part
152.1 lower side wall part
152.2 lower side wall part
153.1 upper wedge opening
153.2 lower wedge opening
156 upper head part
157 lower head part
158 slit
250 connecting head
251.1 upper side wall part
251.2 upper side wall part
252.1 lower side wall part
252.2 lower side wall part

253.1 upper wedge opening
253.2 lower wedge opening
256 upper head part
257 lower head part
258 slit

The invention claimed is:

1. A closed vertical frame intended for construction of a frame support, the closed vertical frame comprising the following features:

(A) the closed vertical frame comprises at least two parallel vertical supports which are arranged at a horizontal spacing from one another and which each have an upper end and a lower end;

(B) the closed vertical frame comprises at least two parallel horizontal arms which are arranged at a vertical spacing from one another and which each extend between the at least two vertical supports transversely to these vertical supports;

(C) the closed vertical frame is stiffened by at least one diagonal bar which extends between two of the vertical supports and two of the horizontal arms and which is welded to two of the vertical supports or to two of the horizontal arms or to both one vertical support of the vertical supports and one horizontal arm of the horizontal arms; and (D) apertured discs, which are each provided with several passages, for connection of holding devices are permanently fastened by welding in the region of the respective upper end or in the region of the respective lower and upper end of at least two of the vertical supports, which apertured discs are arranged concentrically with respect to the respective vertical support and surround the respective vertical support as a flange;

and either (E) a first horizontal arm of the horizontal arms comprises a horizontal strut having at each of its mutually remote ends a respective connecting head which is formed in single-part manner or multi-part manner with the horizontal strut, wherein the respective connecting head is bounded by side wall parts having vertical outer surfaces which taper towards the center and which include a wedge angle, and wherein the respective connecting head has an upper head part and a lower head part, which are integrally connected together and between which is provided a slot, which is open towards the associated vertical support and by way of which the respective connecting head is plugged onto an apertured disc, which protrudes at least partly thereinto, of the apertured discs, and wherein the connecting head respectively plugged onto the associated apertured disc is welded to a vertical support of the vertical supports in the region of the upper end thereof and also to the associated apertured disc, and wherein the vertical supports each have only a single apertured disc, which is respectively permanently fastened by welding in the region of the upper end of the respective vertical support and wherein a second horizontal arm of the horizontal arms is welded at both ends to a respective vertical support of the vertical supports in the region of the lower end thereof, or (F) a first horizontal arm of the horizontal arms and a second horizontal arm of the horizontal arms each comprise a horizontal strut having at each of the mutually remote ends thereof a respective connecting head formed in single-part manner or multi-part manner with the respective horizontal strut, and wherein the respective connecting head of the horizontal arms is bounded by side wall parts having vertical outer surfaces which taper together towards a center and which include a wedge angle, and wherein the respective connecting head of the horizontal arms has an upper head part and a lower head part, which are integrally connected together and between which is provided a slot, which is open towards the associated vertical support and by way of which the respective connecting head of the horizontal arms is plugged onto an apertured disc, which at least partly projects thereinto, of the apertured discs, and wherein the connecting head, which is respectively plugged onto the associated apertured disc, of the first horizontal arm is welded to a vertical support of the vertical supports in the region of the upper end thereof and also to the associated apertured disc, and wherein the connecting head, which is respectively plugged onto the associated apertured disc, of the second horizontal arm is welded to a vertical support of the vertical supports in the region of the lower end thereof and also to the associated apertured disc, and wherein the vertical supports each comprise only two of the apertured discs, of which in each instance a first apertured disc is permanently fastened by welding in the region of the upper end of the respective vertical support and of which in each instance a second apertured disc is permanently fastened by welding in the region of the lower end of the respective vertical support.

2. The vertical frame according to claim 1, wherein the connecting head provided at one end of the ends of the horizontal strut or of the horizontal strut, in each instance, and the connecting head provided at another end of the ends of the horizontal strut or of the horizontal strut, in each instance, facing away from the one end, are structured in a same manner.

3. The vertical frame according to claim 1, wherein each connecting head is connected in one piece with the horizontal strut or with the horizontal strut, in each instance, and produced via forming the horizontal strut, which is configured as a hollow profile.

4. The vertical frame according to claim 1, wherein the vertical frame is configured as an equalization frame that allows height equalization, whereby a length of vertical supports of the equalization frame is smaller than the horizontal distance between longitudinal axes of the vertical supports of the equalization frame.

5. The vertical frame according to claim 4, wherein the vertical supports of the equalization frame are equipped, both in the region of the upper end and in the region of the lower end, with the apertured discs onto which connecting heads of the first horizontal arm and connecting heads of the second horizontal arm are welded.

6. The vertical frame according to claim 4, wherein the vertical supports of the equalization frame are equipped, in each instance, with precisely two apertured discs.

7. The vertical frame according to claim 4, wherein in the case of the equalization frame and/or in the case of the second standard frame, the apertured discs attached in the region of the lower end of their respective vertical supports have a first distance from lower ends of the vertical supports, and wherein the apertured discs attached in the region of the upper end of their respective vertical supports have a second distance from upper ends of the vertical supports, which distance is equally great as the first distance.

8. The vertical frame according to claim 1, wherein the vertical frame is configured as a standard frame, whereby a length of vertical supports of the standard frame is greater than the horizontal distance between longitudinal axes of the vertical supports of the standard frame.

9. The vertical frame according to claim 8, wherein the length of the vertical supports of a first standard frame amounts to about 120% to 160% of the horizontal distance of the longitudinal axes of the vertical supports of the first standard frame, and wherein the vertical supports of the first standard frame are equipped with the apertured discs onto which the connecting heads of the first horizontal arm are welded, only in the region of the upper end, and/or wherein the vertical supports of the first standard frame are equipped with only a single apertured disc, in each instance.

10. The vertical frame according to claim 8, wherein the length of the vertical supports of a second standard frame amounts to about 140% to 180% of the horizontal distance of the longitudinal axes of the vertical supports of the second standard frame, and wherein the vertical supports of the second standard frame are equipped with the apertured discs on which the connecting heads of the first horizontal arm are fixed in place, in the region of the upper end, and also with the apertured discs onto which the connecting heads of the second horizontal arm are welded, in the region of the lower end, and/or wherein the vertical supports of the second standard frame are equipped with precisely two apertured discs, in each instance.

11. The vertical frame according to claim 1, wherein the vertical frame, together with at least one additional vertical frame, forms a frame support, in which these two vertical frames are disposed one on top of another and fixed in place relative to one another, as well as set onto one another.

12. The vertical frame according to claim 1, wherein at least one additional vertical frame is disposed at a horizontal distance from the vertical frame, whereby these vertical frames form part of a three-dimensional, modular, supporting scaffold that is constructed from at least two scaffold diagonals that reinforce the supporting scaffold, forming a polygonal outline, having the following additional characteristics:

the at least two scaffold diagonals connect the at least two vertical frames, in each instance;

the at least two scaffold diagonals are disposed, in each instance, transverse to the vertical supports of the at least two vertical frames and at a horizontal distance from one another;

the at least two scaffold diagonals are releasably attached, in each instance, to the at least two vertical frames; and these at least two scaffold diagonals are vertical diagonals that extend vertically.

* * * * *